US006454394B2

(12) United States Patent
Shibano et al.

(10) Patent No.: US 6,454,394 B2
(45) Date of Patent: Sep. 24, 2002

(54) INKJET HEAD WHICH PREVENTS TRANSFER OF A LOAD APPLIED TO AN INKJET-HEAD-SIDE CONNECTOR

(75) Inventors: Makoto Shibano, Hachioji (JP); Satoshi Sakurai, Hino (JP); Katsuaki Komatsu, Hino (JP); Takuo Nishikawa, Hino (JP)

(73) Assignees: Olympus Optical Co., Ltd., Tokyo (JP); Konica Corporation, Tokyo (JP)

( * ) Notice: Subject to any disclaimer, the term of this patent is extended or adjusted under 35 U.S.C. 154(b) by 0 days.

(21) Appl. No.: 09/811,731

(22) Filed: Mar. 19, 2001

(30) Foreign Application Priority Data

Mar. 21, 2000 (JP) ..... 2000-078724
May 17, 2000 (JP) ..... 2000-145384

(51) Int. Cl.[7] ..... B41J 2/14; B41J 2/16
(52) U.S. Cl. ..... 347/49; 347/50
(58) Field of Search ..... 347/50, 58, 20, 347/84–87, 49, 54, 57

(56) References Cited

U.S. PATENT DOCUMENTS 6,305,785 B1 * 10/2001 Hosaka et al. ..... 347/49

FOREIGN PATENT DOCUMENTS

JP 5-16339 1/1993 ..... B41J/2/01

* cited by examiner

*Primary Examiner*—John Barlow
*Assistant Examiner*—Juanita Stephens
(74) *Attorney, Agent, or Firm*—Frishauf, Holtz, Goodman & Chick, P.C.

(57) ABSTRACT

An inkjet head is provided with a flexible printed circuit cable where a head body for ejecting ink and a connector are mounted at places different from each other, and the flexible printed circuit cable is bent between the head body and the connector so as to absorb tensile and pushing forces applied to the connector. The inkjet head is also provided with an ink ejecting portion for ejecting ink, a head-side connector and a supporting body or a cover for supporting or storing an electric connection portion or a flexible printed circuit cable interposed between the ink ejecting portion and the connector, and the head-side connector is supported by the supporting body or the cover so that the connector is movable in three-dimensional directions.

26 Claims, 11 Drawing Sheets

INKJET HEAD WHICH PREVENTS TRANSFER OF A LOAD APPLIED TO AN INKJET-HEAD-SIDE CONNECTOR

CROSS-REFERENCE TO RELATED APPLICATIONS

This application is based upon and claims the benefit of priority from the prior Japanese Patent Applications No. 2000-078724, filed Mar. 21, 2000; and No. 2000-145384, filed May 17, 2000, the entire contents of both of which are incorporated herein by reference.

BACKGROUND OF THE INVENTION

The present invention relates to an inkjet head used for forming desired images on printing media by ejecting ink drops toward the printing media such as a printing paper supplied to an inkjet printer, and particularly relates to an inkjet head removably supported by a head supporting member such as a carriage of a printer main body of the inkjet printer in order to ease an inspection and a maintenance of the inkjet head.

In a conventional inkjet printer, a head-side connecter is provided on an inkjet head, and an electric-current-supply-side connector is provided on a printer main body of the inkjet printer. The supply-side connector is connected to electric appliances in the inkjet printer. While the inkjet head is attached at a predetermined position on a head supporting member, the head-side connector is removably connected to the electric-current-supply-side connecter. When the inkjet head is removed from the head supporting member, the connection is cancelled.

The electric connection constitution as described above by which the inkjet head can be removably supported at the predetermined position on the head supporting member in the conventional inkjet printer is well-known by, for example, Japanese Patent Application KOKAI publication No. 5-16339. This conventional electric connection constitution is enlarged and schematically shown in FIG. 15 of the present application.

As shown in FIG. 15, the inkjet head supporting structure in the conventional inkjet printer is provided with a carriage 110 as a head supporting member, and the carriage 110 includes an inkjet head supporting base 112 having an inkjet head insertion port 112*a*.

Into the inkjet head insertion port 112*a*, an inkjet head 114 is inserted. The inkjet head 114 is provided with an ink ejecting portion 114*a*, a head-side connector 114*b* arranged to oppose the ink ejecting portion 114*a*, and an electric connecting portion 114c made of a hard board and interposed between the inkjet ejecting portion 114*a* and the head-side connector 114*b*.

The ink ejecting portion 114*a*, the head-side connector 114*b*, and the electrical connecting portion 114*c* are fixed at predetermined positions by a supporting cover (supporting body) 114*d*.

More specifically, the ink ejecting portion 114*a* is fixed on one end of the supporting cover 114*d*, the head-side connector 114*b* is fixed on the other end of the supporting cover 114*d*, and the electric connecting portion 114*c* is arranged between the above described one end and the above described other end in a space covered by the supporting cover 114*d*. In the space covered by the supporting cover 114*d*, an ink supply pipe 114*e* is further arranged and extends from the ink ejecting portion 114*a* to the other end of the supporting cover 114*d*. On one end of the supporting cover 114*d*, an ink ejecting portion protecting portion 114*f* is further attached to surround the ink ejecting portion 114*a*. The head-side connector 114*b* has a plurality of guide projections 114*g* projecting in a direction opposite to the above described one end of the supporting cover 114*d*.

At the end opposing the inkjet head insertion port 112*a* in the inkjet head supporting base 112, an electric-current-supply-side connector 116 is arranged. The supply-side connector 116 is connected to electric appliances of a printer main body through a circuit cable described later. More specifically, on an end surface 112*b* at a side opposing to an entrance of the inkjet head insertion port 112*a*, a plurality of guide projections 112*c* are provided to project therefrom. The electric-current-supply-side connector 116 has a plurality of insertion holes 116*a* into which the plurality of guide projections 112*c* can be inserted. The diameter of each of the plurality of insertion holes 116*a* is set sufficiently larger than that of each of the plurality of guide projections 112*c*. Therefore, the electric-current-supply-side connector 116 can be movable in directions crossing each of the plurality of guide projections 112*c* within a difference between the diameter of each of the plurality of insertion holes 116*a* and the diameter of each of the plurality of guide projections 112*c*.

Around an outer circumferential surface of each of the plurality of guide projections 112*c* is wound a compression coil spring (urging means) 112*d*, so that the coil spring 112*d* is interposed between a projection end of each of the guide projections 112*c* and the end surface of the electric-current-supply-side connector 116. The compression coil springs 112*d* urge the electric-current-supply-side connector 116 toward the end surface 112*b* of the above described opposite side of the inkjet head supporting base 112.

In the carriage 110, a circuit cable 118 is arranged at a position away in the above described opposite direction from the end of the above described opposite side of the inkjet head insertion port 112*a* on the inkjet head supporting base 112. On the circuit cable 118, an electric circuit for controlling an operation of the ink ejecting portion 114*a* of the inkjet head 114 and an operation of the carriage 110 is constituted. From the circuit cable 118, a flexible printed circuit cable 120 extends to the electric-current-supply-side connector 116, and an extended end of the flexible printed circuit cable 120 is connected to the electric-current-supply-side connector 116.

In the carriage 110, an ink tank 122 is further arranged at a position away in the above described opposite direction from the end of the above described opposite side of the inkjet head insertion port 112*a* on the inkjet head supporting base 112. From the ink tank 122, an ink leading pipe 122*a* extends through the end of the above described opposite side of the inkjet head insertion port 112*a* into the inkjet head insertion port 112*a* of the inkjet head supporting base 112.

Into the inkjet head insertion port 112*a* (predetermined position for the inkjet head 114) of the inkjet head supporting base 112 in the carriage 110, the inkjet head 114 is inserted through the above described entrance with the head-side connector 114*b* being as a leading end. At this time, the plurality of the guide projections 114*g* of the head-side connector 114*b* are inserted into the plurality of guide holes 116*a* of the electric-current-supply-side connector 116, and the head-side connector 114*b* can be connected to the electric-current-supply-side connector 116 of the carriage 110 as shown by an arrow A in FIG. 15. Also, by the above insertion, the extended end of the ink leading pipe 122*a* from the ink tank 122 is inserted into the extended end of the ink supply pipe 114*e* of the inkjet head 114 and connected with it in the water-tight manner.

Insertion of the inkjet head 114 into the inkjet head insertion port 112*a* is stopped when a contact surface T of the ink ejecting portion protecting portion 114*f* of the inkjet head 114 is brought into contact with a positioning surface S surrounding the above described entrance of the inkjet head insertion port 112*a* in the inkjet head supporting base 112. In this state, the ink ejecting portion protecting portion 114*f* is fixed by a well-known fixing means on the positioning surface S of the inkjet head supporting base 112. More specifically, a plurality of through holes 114*g* are formed on the ink ejecting portion protecting portion 114*f*, and the above described fixing is performed by inserting a plurality of headed bolts not shown into these through holes 114*g* and screwing them into the positioning surface S.

The diameter of each of the plurality of through holes 114*g* is set larger than the diameter of a screw portion of each of the above described headed bolts not shown and is also set smaller than the diameter of a head portion of each of the above described headed bolts. Thus, while loosening the fixation of the ink ejecting portion protecting portion 114*f* against the positioning surface S by the above described headed bolts, the ink ejecting portion protecting portion 114*f* can be moved on the positioning surface S of the inkjet head supporting base 112 within a range of a clearance between the diameter of each of the plurality of through holes 114*g* and the diameter of the screw portion of each of the above described headed bolt not shown. And, by this movement, positions of a plurality of ink ejecting holes not shown of the ink ejecting portion 114*a* of the inkjet head 114 on the positioning surfaces S of the carriage 110 can be adjusted.

This position adjustment can be easily performed, because the electric-current-supply-side connector 116 can be moved on the above described other end of the inkjet head supporting base 112 within the limited distance as mentioned above in directions crossing each of the plurality of guide projections 112*c* and the electric connection between the circuit cable 118 and the electric-current-supply-side connector 116 in the carriage 110 is performed by a flexible printed circuit cable 120. Moreover, since the electric-current-supply-side connector 116 can easily follow a movement of the head-side connector 114*b* during the above described position adjustment, the electric connection between the electric connecting portion 114*c* of the inkjet head 114 and the circuit cable 118 of the carriage 110 will not be cancelled during the above described position adjustment.

However, in the conventional inkjet head 114 described above with reference to FIG. 15, the ink ejecting portion 114*a*, the head-side connector 114*b*, and the electric connecting portion 114*c* are electrically connected with each other with fixing a positional relation-ship between them, (that is, their positional relation-ship does not have a flexibility), because the electric connecting portion 114*c* is made of the hard board.

Thus, when the inkjet head 114 is inserted into and is removed from the inkjet head insertion port 112*a* (predetermined position) of the inkjet head supporting base 112, the head-side connector 114*b* of the inkjet head 114 is connected to and is disconnected from the electric-current-supply-side connector 116 of the inkjet head supporting base 112 so that a tensile force and a pushing force are applied to the electric connecting portion 114*c* and the head-side connector 114*b*. The tensile force and the pushing force may destroy an electric connection between the head-side connector 114*b* and the electric connecting portion 114*c* and/or an electric connection between the electric connecting portion 114*c* and the ink ejecting portion 114*a*, may cause a failure in the inkjet head 114, and may cause a displacement of the position of the ink ejecting portion 114*a* at the above described one end of the supporting cover 114*d* to reduce an image-printing accuracy.

Alternatively, in order to manufacture an inkjet head with an orientation of the head-side connector 114*b* different from that of the conventional inkjet head 114 shown in FIG. 15, an electric connecting portion with different shape or length from that of the electric connecting portion 114*c* shown in FIG. 15 should be newly prepared so that a manufacturing cost of the inkjet head which is different from the conventional one is increased.

Moreover, the conventional inkjet head supporting structure described above with reference to FIG. 15 requires a large space between the above described other end of the inkjet head supporting base 112 and the circuit cable 118 in the carriage 110, for a structure allowing the movement of the electric-current-supply-side connector 116 and for arranging the flexible printed circuit cable 112. Thus, in the above described conventional inkjet head supporting structure, a dimension along directions in which the inkjet head 114 is inserted into and removed from the inkjet head insertion port 112*a* is large.

The present invention is derived from the above circumstances, and an object of the present invention is to provide an inkjet head which prevents a load, applied to the inkjet-head-side connector when the inkjet head is mounted on or dismounted from a predetermined position in an inkjet printer, from transferring to other members including an ink ejecting portion and an electric connecting portion of the inkjet head, and which can reduce the probability of failure in the inkjet head and prevent an image-printing accuracy of the inkjet head from being lowered.

Another object of the present invention is to provide an inkjet head which can achieve the above described object, which can simplify the inkjet head supporting structure as compared to the conventional types, and which can make an outer dimension of the inkjet head supporting structure smaller than that of the conventional inkjet head supporting structure.

BRIEF SUMMARY OF THE INVENTION

In order to achieve the above described objects of the present invention, an inkjet head according to the present invention comprises: a head body for ejecting ink; a flexible printed circuit cable, connected to the head body, for driving the head body; and a connector, connected to a position different from the head body on the flexible printed circuit cable, for receiving a signal for driving the head body from an external applicance, and for sending the signal to the flexible printed circuit cable, wherein the flexible printed circuit cable is bent between the head body and the connector and absorbs a tensile force and a pushing force both of which are applied to the connector.

When the inkjet head according to the present invention and constituted as mentioned above is used to form a desired image on a printing medium such as a printing paper, the printing head is mounted on a predetermined position of an inkjet head supporting structure of an inkjet printer main body and the head-side connector is connected to an electric-current-supply-side connector of the inkjet head supporting structure.

When the inkjet head is mounted on the predetermined position and is removed from the predetermined position, a pushing force and a tensile force are applied to the head-side connector and the electric-current-supply-side connector.

But, in the inkjet head according to the present invention and constituted as mentioned above, the tensile force and the pushing force are absorbed by the bent flexible printed circuit cable. As a result of this, an electric connection between the head-side connector and the flexible printed circuit cable and an electric connection between the flexible printed circuit cable and the head body are not destroyed, and a failure does not occur in the inkjet head. Further, when the head body of the inkjet head is dislocated or inclined from a predetermined position of the inkjet head, a position adjustment of the head body to the predetermined position can be performed easily because the head body and the head-side connector are connected by the flexible printed circuit cable, and an image-printing accuracy by the head body of the inkjet head does not be lowered.

In the inkjet head according to the present invention and constituted as mentioned above, the flexible printed circuit cable can be bent in any desired manner so that the connector and the head body are oriented in opposite directions, and so that the connector and the head body are arranged such that a straight line along a direction in which the connector is oriented crosses a straight line along a direction in which the head body is oriented.

In the inkjet head in which the flexible printed circuit cable is bent in the above described latter manner, various variations are easily provided that the connector is oriented in various directions to the head body, having the same constitutional members as those of the inkjet head with the flexible printed circuit cable bent as in the above described former manner.

In the inkjet head according to the present invention and constituted as mentioned above, the flexible printed circuit cable is in a shape extending between the head body and the connector, and the flexible printed circuit cable can be bent in a longitudinal direction of the flexible printed circuit cable so that the connector and the head body are oriented in opposite directions.

Alternatively, the flexible printed circuit cable in the shape extending between the head body and the connector, can be bent in a direction crossing a longitudinal direction of the flexible printed circuit cable so that the connector and the head body are arranged such that a straight line along a direction in which the connector is oriented can cross a straight line along a direction in which the head body is oriented.

The long and narrow flexible printed circuit cable can be bent easily at its a position between its both ends, and the bent flexible printed circuit cable is excellent in an efficiency for absorbing an external force applied thereto.

In order to achieve the above-mentioned latter object of the present invention, an inkjet head according to the present invention comprises: an ink ejecting portion to which ink is supplied and which ejects the supplied ink; a head-side connector for an electric connection with a connector of an external electric appliance in a removal manner; an electric connecting portion, interposed between the ink ejecting portion and the head-side connector, for electric connection between the ink ejecting portion and the head-side connector; and a head case for supporting the ink ejecting portion, the head-side connector and the electric connecting portion, wherein the head-side connector is supported by the head case so that the head-side connector is movable in the three-dimensional directions.

When the inkjet head according to the present invention and constituted as mentioned above is used to form a desired image on a printing medium such as a printing paper, the printing head is mounted on a predetermined position of an inkjet head supporting structure of an inkjet printer main body and the head-side connector is connected to an electric-current-supply-side connector of the inkjet head supporting structure.

When the inkjet head is mounted on the predetermined position and is removed from the predetermined position, a pushing force and a tensile force are applied to the head-side connector and the electric-current-supply-side connector.

But, in the inkjet head according to the present invention and constituted as mentioned above, since the head-side connector is supported by the head case so that the head-side connector is movable in the three-dimensional directions, the tensile force and the pushing force are absorbed by the above movement of the head-side connector. As a result of this, an electric connection between the head-side connector and the electric connecting portion is not destroyed, and a failure does not occur in the inkjet head. Further, when the ink ejecting portion (that is, the head body) of the inkjet head at the predetermined position of the inkjet head supporting structure of the inkjet printer is dislocated or inclined, the flexibility of the flexible printed circuit cable allows a smooth and easy dislocation or inclination of the ink ejecting portion to the flexible printed circuit cable and the head-side-connector, and an image-printing accuracy by the ink ejecting portion (that is, head body) of the inkjet head can be maintained easily. Moreover, compared to the conventional example that the electric-current-supply-side connector is supported at the predetermined position of the inkjet head supporting structure of the inkjet printer and is movable in the three-dimensional directions, the constitution of the inkjet head supporting structure can be simplified, and the outer dimension thereof can be made smaller than that of the conventional inkjet head supporting structure.

The inkjet head according to the present invention and constituted as mentioned above is preferably provided with an urging means, provided at the head case, for urging the head-side connector at the predetermined position of the inkjet head supporting structure of the inkjet printer toward the connector of the external electric appliance.

While the inkjet head according to the present invention is not arranged at the predetermined position of the inkjet head supporting structure of the inkjet printer and the head-side connector is not connected to the electric-current-supply-side connector of the external electric appliance, the head-side connector can be freely movable in the three-dimensional directions in the head case of the inkjet head and not stable. The above described urging means stably holds the head-side connector at a predetermined position in the head case of the inkjet head. As a result of this, when the inkjet head is arranged at the predetermined position of the inkjet head supporting body of the inkjet printer, the electric-current-supply-side connector of the external electric appliance can be easily connected to the head-side connector.

In the inkjet head according to the present invention and constituted as mentioned above, the electric connecting portion is preferably arranged between the ink ejecting portion and the head-side connector so that the electric connection portion is in capable of relative movement at least against the head-side connector and the electric connection portion allows the movement of the head-side connector in the three-dimensional directions.

With this constitution, the external force applied to the head-side connector as mentioned above is further weakened at the electric connecting portion.

At least a part of such an electric connecting portion has flexibility.

When at least a part of the electric connecting portion has elasticity, such an electric connecting portion can function as the above described urging means.

Such an electric connecting portion can omit an independent urging means, and makes the constitution of the inkjet head according to the present invention simple in comparison with a case where an urging means is formed independently of the electric connecting portion.

In order to achieve the above latter object of the present invention, an inkjet head according to the present invention is an inkjet head which is incorporated at a predetermined position of a supporting means of an inkjet printer and connected to an electric-current-supply-side connector, and which comprises an ink ejecting portion for ejecting ink; a head-side connector for removably connected to the electric-current-supply-side connector; a flexible printed circuit cable, interposed between the ink ejecting portion and the head-side connector, for electric connection between the ink ejecting portion and the head-side connector; and a case for housing the ink ejecting portion, the head-side connector and the flexible printed circuit cable, wherein the ink ejecting portion is fixed to the case and the head-side connector is held by the case so that the head-side connector is movable in the three-dimensional directions.

In another inkjet head according to the present invention and constituted as mentioned above, since the head-side connector is supported by the case so that the connector is removable in the three-dimensional directions, the tensile force and the pushing force applied to the head-side connector when the inkjet head is mounted on and dismounted from the predetermined position of the supporting means of the inkjet printer and the electric-current-supply-side connector are connected to and are disconnected from the head-side connector, is absorbed by the above described movement of the head-side connector. As a result, an electric connection between the head-side connector and the electric connecting portion is not destroyed, and a failure does not occur in the inkjet head. Further, the ink ejecting portion (that is, the head body) of the inkjet head at the predetermined position of the supporting means of the inkjet printer can be dislocated or inclined easily in order to improve an image-printing accuracy by the ink ejecting portion (that is, head body) of the inkjet head while the head-side connector is connected to the electric-current-supply-side connector.

The flexible printed circuit cable makes a movement of the head-side connector in each of the three-dimensional directions in the case of the inkjet head being more easy, an electric connection structure between the head-side connector and the ink ejecting portion (that is, head body) in the inkjet head being more simple, and, moreover, an electric connection work between them being more easy.

When the flexible printed circuit cable is movable between the ink ejecting portion and the head-side connector within the case, the flexible printed circuit cable further facilitates the movement of the head-side connector in each of the three-dimensional directions, and can better absorb an external force applied thereto from the head-side connector.

The above-mentioned movability of the flexible printed circuit cable is easily achieved by setting the length of the flexible printed circuit cable placed between the head-side connector and the ink ejecting portion being longer than the shortest distance between the head-side connector and the ink ejecting portion.

The above-mentioned movability of the flexible printed circuit cable is further easily achieved by bending the flexible printed circuit cable between the ink ejecting portion and the head-side connector within the case. This bending can be twice or more than twice.

Here, the flexible printed circuit cable can be bent so that the head-side connector and the ink ejecting portion are orientated in opposite directions, or can be bent so that the head-side connector and the ink ejecting portion are arranged such that a straight line along a direction in which the head-side connector is oriented crosses a straight line along a direction in which the ink ejecting portion is oriented.

The inkjet head in which the flexible printed circuit cable is bent in the above described latter manner easily provides various variations that the connector is oriented in various directions to the head body, having the same constitutional members as those of the inkjet head with the flexible printed circuit cable bent in the above described former manner.

The inkjet head is preferably provided with an urging means for urging the head-side connector outward.

While the inkjet head according to the present invention is not mounted at the predetermined position of the supporting means of the inkjet printer and the head-side connector is not connected to the electric-current-supply-side connector of the external electric appliance, the head-side connector can be movable in each of the three-dimensional directions in the case of the inkjet head and not stable. The above mentioned urging means stably holds the head-side connector at a predetermined position in the case of the inkjet head during the above described time. As a result of this, when the inkjet head is arranged at the predetermined position of the supporting means of the inkjet printer, the electric-current-supply-side connector of the external electric appliance can be easily connected to the head-side connector.

On the flexible printed circuit cable, an ink ejection driving integrated circuit for driving an ink ejection operation of the ink ejecting portion can be mounted.

In this way, since there is no need to provide the ink ejection driving integrated circuit around the predetermined position of the supporting means of the inkjet printer, a structure around the predetermined position can be simple.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

Figure 1:
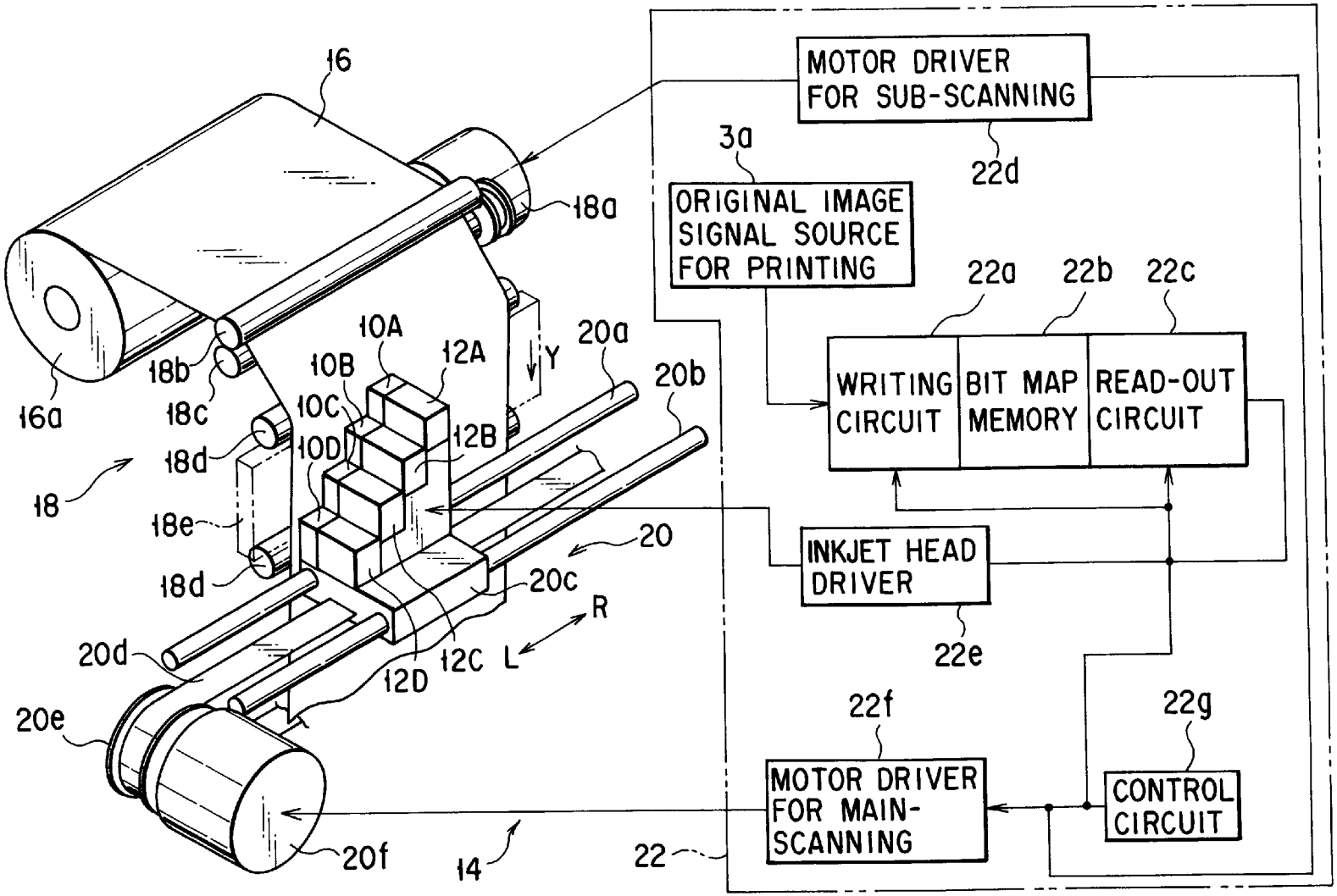
FIG. 1 is a perspective view schematically showing a constitution of a main portion of an inkjet printer provided with a plurality of inkjet head supporting structures on which a plurality of inkjet heads, each according to a preferred embodiment of the present invention, are mounted.

Hereinafter, the inkjet head according to these two preferred embodiments of the present invention, the inkjet head supporting structure used in combination with these inkjet heads, and various variations of the above described inkjet heads will be explained in detail with reference to FIG. 1 through FIG. 14 attached herewith.

DETAILED DESCRIPTION OF THE INVENTION

At first, with reference to FIG. 1, a constitution and an operation of a main portion of each of inkjet heads 10A, 10B, 10C, and 10D according to a first or second embodiment of the present invention, and those of a main portion of an inkjet printer 14 provided with inkjet head supporting structures 12A, 12B, 12C, and 12D to be used in combination with these inkjet heads 10A, 10B, 10C, and 10D will be described.

The inkjet printer 14 is provided with a recording media source 16*a* in which a recording media (recording paper, for example) is wound in a rolled state, and a recording media running guide means 18 for moving the recording media 16 drawn from the recording media source 16*a* along a predetermined running path. The recording media running guide means 18 includes a pair of paper feed rollers 18*b*, 18*c* driven by a rotation driving source (a step motor, for example) 18*a*, and a plurality of running guide rollers 18*d*. The paper feed rollers 18*b*, 18*c* pinch the recording media 16 drawn from the recording media source 16*a* and feed the pinched recording media 16 in a predetermined direction. The guide rollers 18*d* guide a movement of the recording media 16 fed by the pair of paper feed rollers 18*b*, 18*c* along the predetermined running path. The recording media running guide means 18 further includes a flat platen 18*e* arranged along the above described running path.

The inkjet printer 14 is also provided with a carriage means 20 for reciprocally moving the inkjet head supporting structures 12A, 12B, 12C and 12D within a predetermined range in directions (main scanning directions) R, L perpendicular to a predetermined moving direction Y (sub scanning direction) of the recording media 16 on the platen 18*e*, along a recording media facing surface of the platen 18*e*.

The carriage means 20 is provided with a pair of carriage guide rods 20*a*, 20*b* extending in parallel with each other in the above described main scanning directions R, L. On the pair of carriage guide rods 20*a* and 20*b*, a carriage body 20c is supported so that the carriage body 20*c* is movable along the carriage guide rods 20*a*, 20*b*. A circular power transmission belt 20*d* extends along the pair of carriage guide rods 20*a*, 20*b*, and a part of the belt 20*d* is fixed to the carriage body 20*c*. One end of the power transmission belt 20*d* is wound around an output portion 20*e* of a rotation driving source 20*f* and another end is wound around an idle wheel not shown. The rotation driving source 20*f* consists of a step motor, and the output portion 20*e* consists of an output pulley fixed to an output shaft of the step motor. In addition to the pair of carriage guide rods 20*a*, 20*b*, this carriage means 20 includes the carriage body 20*c*, the power transmission belt 20*d*, and the rotation driving source 20*f* with the output portion 20*e*.

On the carriage body 20*c*, the inkjet head supporting structures 12A, 12B, 12C and 12D are placed. The inkjet heads 10A, 10B, 10C, and 10D are removably supported by the inkjet head supporting structures 12A, 12B, 12C and 12D. While the carriage 20*c* is reciprocally moved within the predetermined range along the pair of carriage guide rods 20*a* and 20*b* by the driving force from the rotation driving source 20*f*, the inkjet heads 10A, 10B, 10C, and 10D face the recording media 16 on the platen 18*e*.

The inkjet head supporting structures 12A, 12B, 12C and 12D have ink storage tanks (not shown) storing ink in black, cyan, magenta, and yellow. When the inkjet heads 10A, 10B, 10C, and 10D are removably supported by the inkjet head supporting structures 12A, 12B, 12C and 12D, the ink storage tanks (not shown) are connected to the inkjet heads 10A, 10B, 10C, and 10D.

In this embodiment, the four inkjet heads 10A, 10B, 10C, and 10D respectively correspond to black, cyan, magenta, and yellow, but one inkjet head can correspond to plural colors.

The inkjet printer 14 is further provided with an electric control means 22 for electrically controlling an operation of the inkjet printer 14.

The electric control means 22 includes a writing circuit 22*a*, a bitmap memory 22*b* and a read-out circuit 22*c*.

Into the writing circuit 22*a*, an original image signal corresponding to an image to be formed on the recording media 16 on the platen 18*e* by the inkjet printer 14 is inputted from an original image signal source (a personal computer, for example). The bitmap memory 22*b* converts the original image signal, inputted into the writing circuit 22*a*, into bitmap data and stores the data. The bitmap data is necessary for recording a desired image, corresponding to the print original image signal, on the recording media 16 on the platen 18*e* by the four inkjet heads 10A, 10B, 10C, and 10D. The read-out circuit 22*c* reads the bitmap data out of the bitmap memory 22*b*.

The electric control means 22 further includes a motor driver 22*d* for sub-scanning, an inkjet head driver 22*e*, a motor driver 22*f* for main-scanning, and a control circuit 22*g*.

The motor driver 22*d* for sub-scanning is electrically connected to the rotation driving source (a sub-scanning motor) 18*a* for running the recording media 16 in the sub scanning direction Y. The inkjet head driver 22*e* is electrically connected to the inkjet heads 10A, 10B, 10C, and 10D through the inkjet head supporting structures 12A, 12B, 12C and 12D. The motor driver 22*f* for main scanning is electrically connected to the rotation driving source (a main scanning motor) 20*f* for running the carriage body 20*c* in the main scanning directions L, R. The control circuit 22*g* is connected to the writing circuit 22*a*, the read-out circuit 22*c*, the sub-scanning motor driver 22*d*, the inkjet head driver 22*e*, and the main-scanning motor driver 22*f*.

In the electric control means 22, the read-out circuit 22*c* is further connected to the sub-scanning motor driver 22*d*, the inkjet head driver 22*e*, and the main-scanning motor driver 22*f*.

In order to read the desired image, corresponding to the original image signal inputted in the writing circuit 22*a*, on the recording media 16 on the platen 18*e* by using the four inkjet heads 10A, 10B, 10C, and 10D, the electric control means 22 operates as follows.

That is, the control circuit 22*g*, controls the read-out to read the bitmap data corresponding to the original image signal out of the bitmap memory 22*b*. Further, the control circuit 22*g* controls the sub-scanning motor driver 22*d*, the inkjet head driver 22*e*, and the main-scanning motor driver 22*d* to drive the sub-scanning motor 18*a*, the inkjet heads 10A, 10B, 10C, and 10D and the main-scanning motor 20*f* on a basis of the bitmap data. As a result of this, the sub-scanning motor 18*a* runs the recording media 16 on the platen 18*e* in the sub-scanning direction Y with a predetermined interval at a predetermined speed, and the main-scanning motor 20*f* reciprocally moves the carriage body 20*c* along the pair of carriage guide rods 20*a*, 20*b* within the predetermined range with a predetermined interval at a predetermined speed. Moreover, while the carriage body 20*c* is reciprocally moved in this way, the inkjet heads 10A, 10B, 10C, and 10D eject black, cyan, magenta, and yellow ink toward the recording media 16 on the platen 18*e* at a predetermined timing based on the bitmap data.

The constitution and operation of the main portion of the inkjet printer 14 as mentioned above are well-known, and further explanation about them will be omitted.

Next, the first embodiment of the present invention of each of the inkjet heads 10A, 10B, 10C, and 10D used in the inkjet printer 14 mentioned above with reference to FIG. 1 will be explained in detail, referring to FIG. 2 through FIG. 6.

The constitution of each of the inkjet heads 10A, 10B, 10C, and 10D is identical to each other, and thus, the constitution of each of the inkjet head supporting structures 12A, 12B, 12C and 12D is identical to each other. Accordingly, in the following explanation, the inkjet head according to the first embodiment is denoted by a reference numeral 1, and the inkjet head supporting structure according to the first embodiment is denoted by a reference numeral 2.

Figure 2:
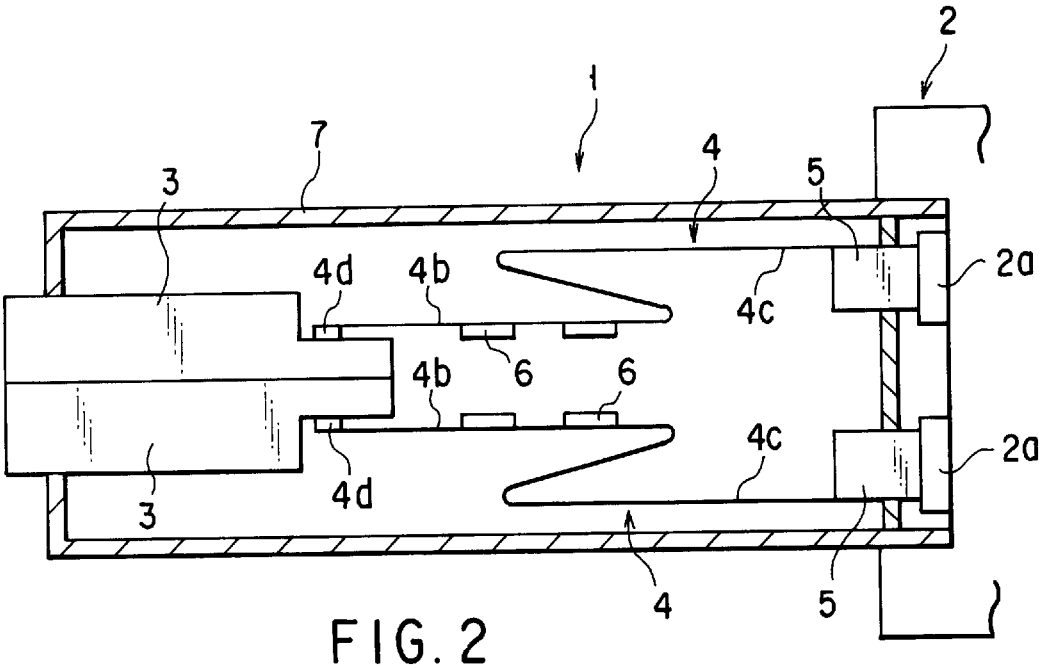
FIG. 2 is a horizontal cross sectional view schematically showing a state where an inkjet head according to a first embodiment of the present invention is mounted at a predetermined position of a corresponding inkjet head supporting structure of the inkjet printer.

The inkjet head 1 of the first embodiment is, as shown in FIG. 2, provided with a plurality of (a pair in this embodiment) ink ejecting portions 3 (that is, the head body) for ejecting ink, and a flexible printed circuit cable 4, connected to each of the ink ejecting portion 3, for driving the ink ejecting potion 3. In each of the flexible printed circuit cable 4, a head-side connector 5 is connected at a position different from the ink ejecting portion 3.

Figure 3:
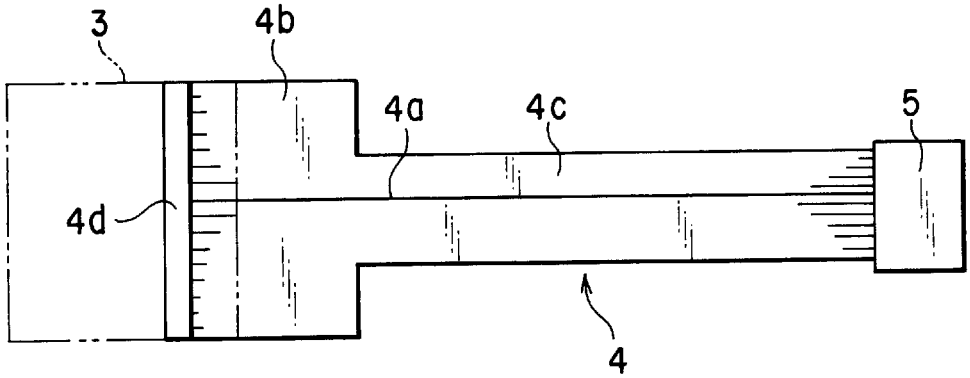
FIG. 3 is a side view showing a long and narrow flexible printed circuit cable in an extended state, the flexible printed circuit cable being used in the inkjet head in FIG. 2, and an ink ejecting portion as a head body and a head-side connector being electrically connected to both ends of the flexible printed circuit cable in its longitudinal direction.

In this embodiment, the flexible printed circuit cable 4 has a long and narrow shape in general, and the ink ejecting portion 3 and the head-side connector 5 are connected to at the both ends of the flexible printed circuit cable 4 in its longitudinal direction. In FIG. 3, the flexible printed circuit cable 4 is exploded, and a plurality of signal lines 4*a*, extending along a longitudinal direction of the flexible printed circuit cable 4 between the both ends on the flexible printed circuit cable 4, can be seen.

The flexible printed circuit cable 4 includes a main portion 4*b*, located adjacent to the ink ejecting portion 3 and having the same width as that of the ink ejecting portion 3, and a long and narrow extending portion 4*c*, extending from the main portion 4*b* to the head-side connector 5 and having a width smaller than that of the main portion 4*b*. The width of the extending portion 4*c* is the same as that of the head-side connector 5. The main portion 4*b* is provided with an ink ejecting portion (head body) connecting portion 4*d* to which the ink ejecting portion 3 is connected. The ink ejecting portion 3 and the head-side connector 5 are oriented in the opposite directions at the both ends.

The head-side connector 5 receives a signal for driving the ink ejecting portion 3, from outside and sends the signal to the flexible printed circuit cable 4. On the flexible printed circuit cable 4, an integrated circuit 6 for driving ink ejecting portion 3 is arranged.

Figure 4:
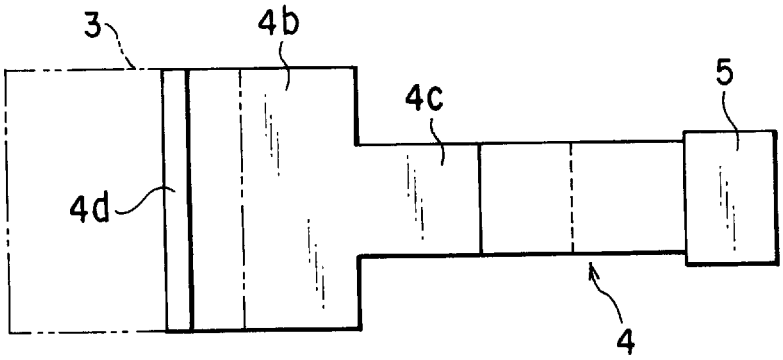
FIG. 4 is a side view showing the flexible printed circuit cable shown in FIG. 3 in a state in which the flexible printed circuit cable is bent so that the ink ejecting portion as the head body and the head-side connector are oriented in the opposite directions.

The flexible printed circuit cable 4, together with the ink ejecting portion 3, the head-side connector 5 and the integrated circuit 6 for driving ink ejecting portion, is housed in a case 7. The ink ejecting portion 3 and the head-side connector 5 are fixed at predetermined positions on the both ends of the case 7. Since the length in the longitudinal direction of the flexible printed circuit cable 4 is set longer than the shortest distance between the ink ejecting portion 3 and the head-side connector 5 at the predetermined positions on the both ends of the case 7, the flexible printed circuit cable 4 is bent twice in the case 7 as shown in FIGS. 2 and 4. In this embodiment, after the above described bending of the flexible printed circuit cable 4, the ink ejecting portion 3 and the head-side connector 5 are oriented in the opposite directions at the both ends, and the longitudinal center line of the flexible printed circuit cable 4 is not dislocated in the width direction of the flexible printed circuit cable 4 at the both ends.

The number of times of bending of the extending portion 4*c* is not limited, but bent region of the extending portion 4*c* should not increase the thickness of the flexible printed circuit cable 4 in the case 7 in such an extent that it prevent the bent region of the extending portion 4*c* of the flexible printed circuit cable 4 from moving or bending freely in the case 7 when a pressing force or a tensile force is applied to the flexible printed circuit cable 4 and that it prevent the bent region from absorbing these forces.

In this embodiment, the flexible printed circuit cable 4 is housed in the case 7 in such a bent state in its longitudinal direction as mentioned above, and the ink ejecting portion 3 and the head-side connector 5 are fixed at the predetermined positions on the both ends of the case 7. Therefore, the dimensional accuracy of the length of the flexible printed circuit cable 4 can be made loose, and the ink ejecting portion 3 and the head-side connector 5 can be fixed precisely but easily to the predetermined positions on the both ends of the case 7 without causing a manufacturing cost of the inkjet head 1 of this embodiment to be increased.

When this inkjet head 1 is mounted at the predetermined position on the inkjet head supporting structure 2, the head-side connector 5 is pressed toward an electric-current-supply-side connector 2*a* of the inkjet head supporting structure 2 in the longitudinal direction of the flexible printed circuit cable 4, and is connected to the electric-current-supply-side connector 2*a*. At this time, a pressing force is applied both to the head-side connector 5 and the electric-current-supply-side connector 2*a*. Also, when the inkjet head 1 is removed from the predetermined position of the inkjet head supporting structure 2 to perform a maintenance of the inkjet head 1, for example, the head-side connector 5 is removed from the electric-current-supply-side connector 2*a* of the inkjet head supporting structure 2 in the longitudinal direction of the flexible printed circuit cable 4, and the connection with the electric-current-supply-side connector 2*a* is cancelled. At this time, a tensile force is applied both to the head-side connector 5 and the electric-current-supply-side connector 2*a*.

Such a pressing force and a tensile force are transmitted to the flexible printed circuit cable 4 through the head-side connector 5 but are absorbed by the bent region of the flexible printed circuit cable 4. Therefore, the above pressing force and the tensile force are applied in a reduced state to the connecting portion between the head-side connector 5 and the flexible printed circuit cable 4 and almost all of the these forces is not transmitted to the connecting portion between the flexible printed circuit cable 4 and the ink ejecting portion (head body) 3 or to the ink ejecting portion (head body) 3. And, by these pressing force and tensile force, the connecting portion between the head-side connector 5 and the flexible printed circuit cable 4, and the connecting portion between the flexible printed circuit cable 4 and the ink ejecting portion (head body) 3 are not destroyed, and further the ink ejecting portion (head body) 3 is not dislocated from the predetermined position in the case 7. Also, the life of the inkjet head 1 is improved.

Next, referring to FIG. 5, a first variation of the inkjet head 1 according to the first embodiment mentioned above with reference to FIG. 2 through FIG. 4 will be explained.

The difference of an inkjet head 1' of this variation from the inkjet head 1 according to the above-mentioned first embodiment is that the flexible printed circuit cable 4 is bent and housed in the case 7 such that the ink ejecting portion (head body) 3 and the head-side connector 5 are oriented in the opposite directions and are vertically dislocated.

Thus, the position of an electric-current-supply-side connector 2'*a* in an inkjet head supporting structure 2' to which the inkjet head 1' of this first variation is mounted, is also vertically dislocated from the position of the electric-current-supply-side connector 2*a* of the inkjet head supporting structure 2 to which the inkjet head 1 according to the above-mentioned first embodiment is mounted.

Figure 5:
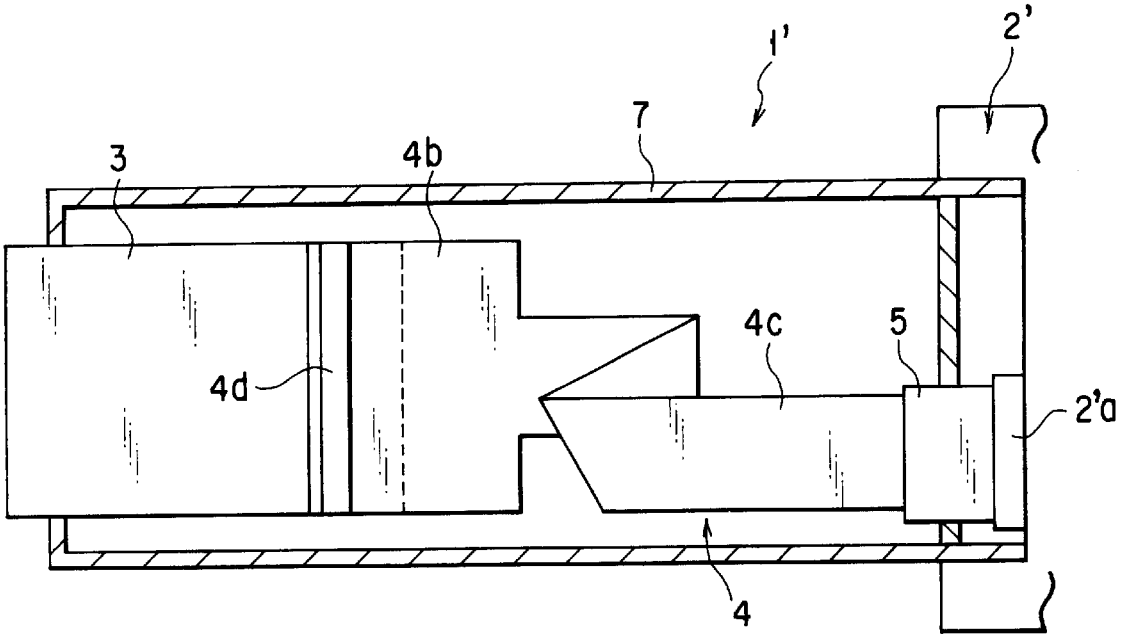
FIG. 5 is a schematic vertical cross sectional view of a first variation of the inkjet head according to the first embodiment shown in FIG. 2 to FIG. 4, in this variation, the flexible printed circuit cable being bent and housed in a case of the inkjet head in a state where the ink ejecting portion as the head body and the head-side connector are oriented in the opposite directions and dislocated in the vertical direction.

And, as shown in FIG. 5, while the inkjet head 1' of the first variation is mounted at the predetermined position of the inkjet head supporting structure 2' and the electric-current-supply-side connector 2'*a* is connected to the head-side connector 5, no stress is applied both to the electric-current-supply-side connector 2'*a* and the head-side connector 5.

Figure 6:
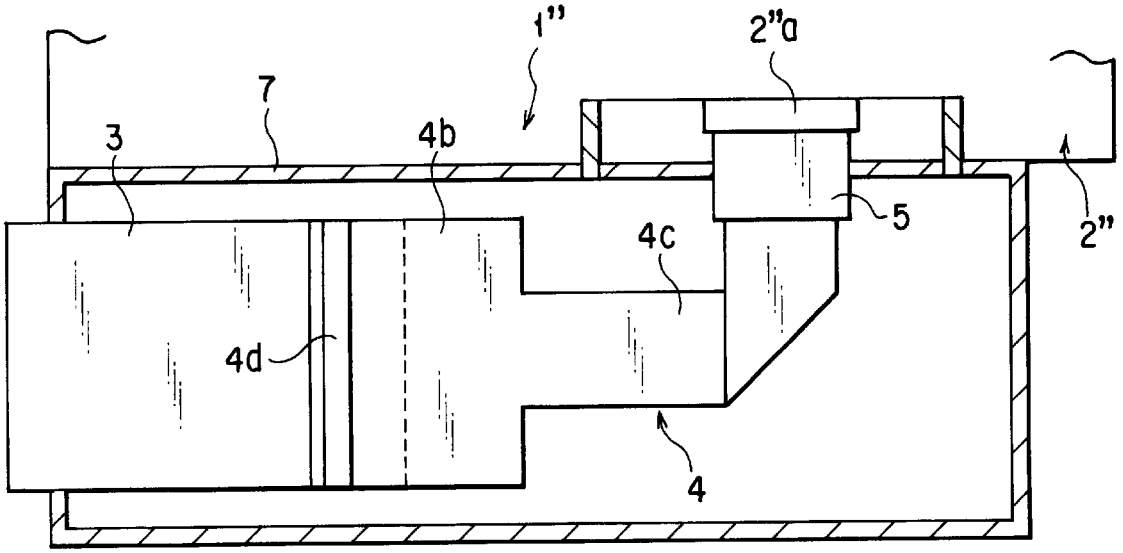
FIG. 6 is a schematic vertical cross sectional view of a second variation of the inkjet head according to the first embodiment shown in FIG. 2 to FIG. 4, in this variation, the flexible printed circuit cable being bent and housed in the case of the inkjet head in a state where the ink ejecting portion as the inkjet head and the head-side connector are arranged such that a straight line along a direction in which the ink ejecting portion is oriented crosses at right angles a straight line along a direction in which the head-side connector is oriented.
Figure 7A:
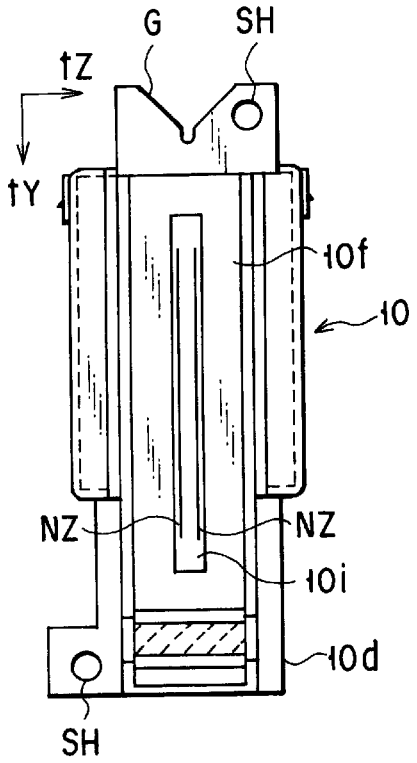
FIG. 7A is a front view of an inkjet head according to a second embodiment of the present invention.
Figure 7B:
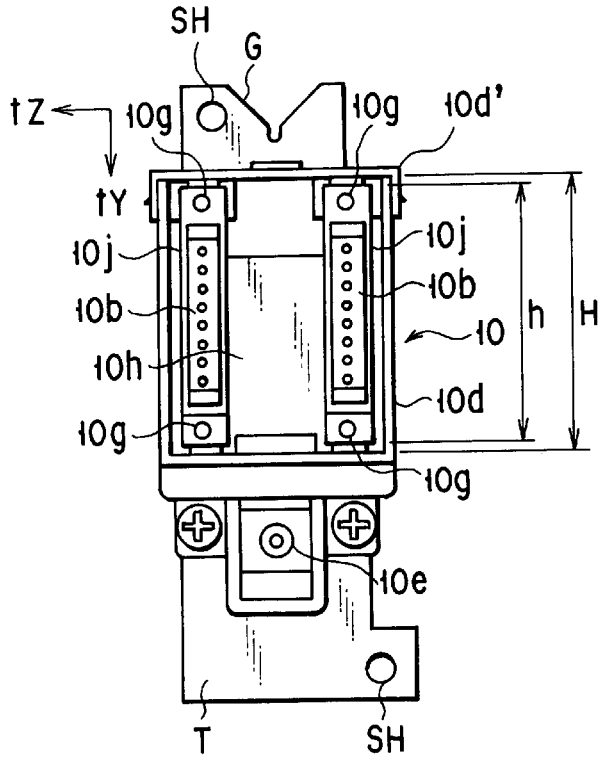
FIG. 7B is a rear view of the inkjet head shown in FIG. 7A.
Figure 7C:
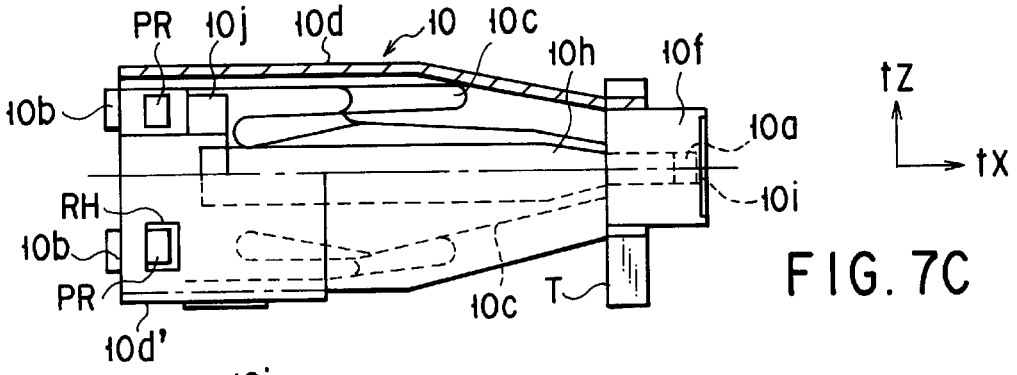
FIG. 7C is a semi-sectional top view of the inkjet head shown in FIG. 7A.
Figure 7D:
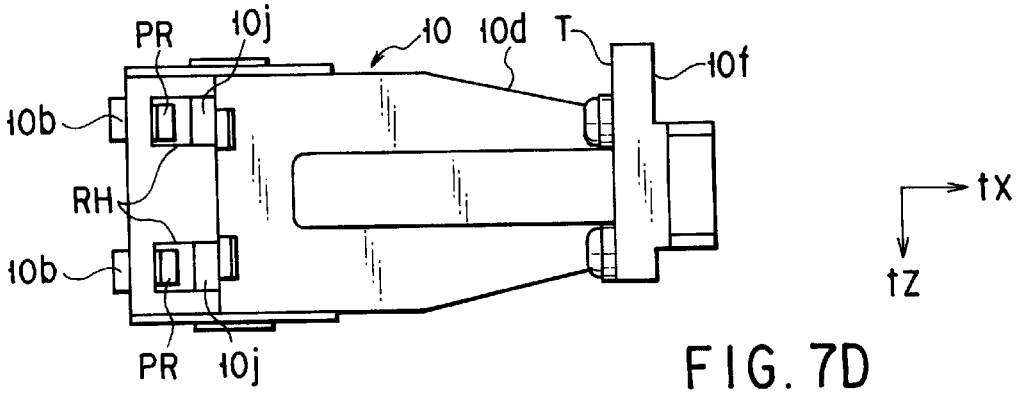
FIG. 7D is a bottom view of the inkjet head shown in FIG. 7A.

Then, referring to FIG. 6, a second variation of the inkjet head 1 according to the above-mentioned first embodiment will be explained with reference to FIG. 2 through FIG. 4.

The difference of an inkjet head 1" of this variation from the inkjet head 1 according to the above-mentioned first embodiment is that the flexible printed circuit cable 4 is bent so that the head-side connector 5 and the ink ejecting portion (head body) 3 are arranged such that a straight line along a direction in which the head-side connector 5 is oriented crosses a straight line along a direction in which the ink ejecting portion (head body) 3 is oriented.

In this variation, the direction in which the ink ejecting portion (head body) 3 is oriented crosses the direction in which the head-side connector 5 is oriented almost at 90 degrees.

Thus, the position of an electric-current-supply-side connector 2"*a* in an inkjet head supporting structure 2" to which the inkjet head 1" of this second variation is mounted is also vertically dislocated almost at 90 degrees, compared to the direction in which the electric-current-supply-side connector 2*a* of the inkjet head supporting structure 2 used in combination with the inkjet head 1 according to the above-mentioned first embodiment is oriented.

More concretely, the electric-current-supply-side connector 2"*a* in the inkjet head supporting structure 2" to which the inkjet head 1" of this second variation is mounted is oriented almost vertically downward.

And as shown in FIG. 5, while the inkjet head 1" of the second variation is mounted at the predetermined position of the inkjet head supporting structure 2" of the second variation and the electric-current-supply-side connector 2"*a* is connected to the head-side connector 5, the ink ejecting portion (head body) 3 is oriented in the almost horizontal predetermined direction and no stress is applied both to the electric-current-supply-side connector 2"*a* and the head-side connector 5.

The angle that the straight line along the direction in which the head-side connector 5 is oriented crosses the straight line along the direction in which the ink ejecting portion (head body) 3 is oriented can be set at any degrees by setting the angle to bent the flexible printed circuit cable 4 at any degree.

As explained in detail, in the inkjet head 1 according to the first embodiment, the inkjet heads 1' and 1" in various forms can be easily manufactured from one type of the flexible printed circuit cable 4 having one type of the ink ejecting portion (head body) 3 and one type of the head-side connector 5. Thus, various types of inkjet heads can be manufactured inexpensively.

Next, referring to FIG. 2, the second embodiment of the present invention of each of the inkjet heads 10A, 10B, 10C, and 10D used in the above-mentioned inkjet printer 14 and the inkjet head supporting structures 12A, 12B, 12C and 12D to be combined with these inkjet heads 10A, 10B, 10C, and 10D will be explained in detail referring to FIG. 7A through FIG. 11.

The constitution of each of the inkjet heads 10A, 10B, 10C, and 10D is identical to each other, and thus, the constitution of each of the inkjet head supporting structures 12A, 12B, 12C and 12D is identical to each other. Accordingly, in the following explanation, the inkjet head according to the second embodiment is denoted by a reference numeral 10, and the inkjet head supporting structure according to the second embodiment is denoted by a reference numeral 12.

The inkjet head 10 according to the second embodiment of the present invention is provided with an ink ejecting portion (that is, a head body) 10*a*, a pair of head-side connectors 10*b*, and a pair of electrical connecting portions 10*c* interposed between the ink ejecting portion 10*a* and the head-side connectors 10*b*. The ink ejecting portion 10*a* includes a number of ink ejecting means (not shown) for ejecting ink supplied thereto, the ink ejecting means being arranged in the predetermined arrangement. The pair of head-side connectors 10*b* are used for removable electric connection with connectors of an external electric appliance. The pair of electric connecting portions 10*c* performs an electric connection between the ink ejecting portion 10*a* and the head-side connector 10*b*. The ink ejecting portion 10*a*, the pair of head-side connectors 10*b* and the pair of electric connecting portions 10*c* are housed in a supporting cover (supporting case) 10*d* and supported at a predetermined positions therein.

More specifically, the ink ejecting portion 10*a* is arranged at one end of the +X side of the supporting cover 10*d*, the pair of head-side connectors 10*b* are arranged side by side at the other end of the −X side of the supporting cover 10*d*, and the electric connection potions 10*c* are arranged between the one end and the other end of the supporting cover 10*d* in the supporting cover 10*d*.

An ink supply pipe 10*e* is further arranged in the supporting cover 10*d*, and the pipe 10*e* extends from the ink ejecting portion 10*a* to the other end of the supporting cover 10*d*. An ink ejecting portion protecting portion 10*f* is attached to one end of the supporting cover 10*d*, and the protecting portions 10*f* surrounds the ink ejecting portion 10*a*. The head-side connector 10*b* has a plurality of connection guide holes 10*g*.

On the −X side of the ink ejecting portion 10*a* in the supporting cover 10*d*, an ink manifold 10*h* is arranged adjacent to the ink ejecting portion 10*a*. The ink manifold 10*h* leads the ink supplied from the ink supply pipe 10*e* to each of the ink ejecting means (not shown) arranged in the predetermined arrangement in the ink ejecting portion 10*a*.

A nozzle plate 10*i* is fixed on the ink ejecting portion protecting portion 10*f*, and a number of nozzles NZ are formed in the protecting portion 10*f* in a predetermined arrangement to correspond to the number of ink ejecting means (not shown) of the ink ejecting portion 10*a*. A surface of the ink ejecting portion protecting portion 10*f*, facing the other end of the −X side of the supporting cover 10*d*, is constituted as a contact surface T.

In this embodiment, each of the pair of electric connecting portions 10*c* is constituted by a flexible printed circuit cable. An electronic or electric circuit is formed on the flexible printed circuit cable, and the circuit includes various electronic or electric parts (not shown) for controlling the operation of the ink ejecting means (not shown) of the ink ejecting portion 10*a*.

In the supporting cover 10*d*, the pair of electric connecting portions 10*c* are arranged along the both side surfaces of the +Z side and the −Z side of the ink manifold 10*h* between the ink ejecting portion 10*a* at one end of the supporting cover 10*d* and the pair of head-side connectors 10*b* at the other end of the supporting cover 10*d*. The end of the +X side of each of the electric connecting portion 10*c* is electrically connected to the ink ejecting portion 10*a*, and the end of the −X side is electrically connected to one of the head-side connectors 10*b* corresponding thereto. Moreover, each of the pair of electric connecting portions 10*c* is bent on each side of the ink manifold 10*h* so that a movement of each of the pair of head-side connectors 10*b* in the three-dimensional directions is allowed.

Each of the pair of head-side connectors 10*b* is provided with engagement projections PR projecting from its end surface in the +Y direction and its end surface in the −Y direction in the +Y direction and in the −Y direction. At positions in the other end of the supporting cover 10*d*, corresponding to the end surface of the +Y direction and the end surface of the −Y direction of each of the pair of head-side connectors 10*b*, engagement recesses RH are formed for receiving the engagement projections PR in the +Y direction and in the −Y direction of each of the pair of head-side connectors 10*b*. The dimension of each of the engagement recesses RH is set larger than that of each of the engagement projections PR. Thus, the movement of each of the engagement projections PR in each of the engagement recesses RH in the +X direction, in the −X direction, in the +Z direction and in the −Z direction is allowed, and thus, the movement of each of the pair of head-side connectors 10*b* at the other end of the supporting cover 10*d* in the +X direction, in the −X direction, in the +Z direction and in the −Z direction is allowed.

In this embodiment, a portion 10*d'*, including the pair of engagement recesses RH on the end surface of the −Y side, at the other end of the supporting cover 10*d* enables removable arrangement of the pair of head-side connectors 10*b*, each having the engagement projections PR, onto the other end of the supporting cover 10*d*.

The distance H between the inner surface of the end portion in the +Y direction at the other end of the supporting cover 10*d* and the inner surface of the end portion in the −Y direction at the other end thereof is set larger than the distance h between the end surface in the +Y direction and the end surface in the −Y direction of each of the pair of head-side connectors 10*b* but smaller than the distance h plus the height of each of the engagement projections PR. By setting the distances as described above, the movement of each of the pair of head-side connectors 10*b* is allowed in the +Y direction and in the −Y direction at the other end of the supporting cover 10*d*. The above-mentioned distance H can be set in any value regardless of the above-mentioned condition by placing a three-dimensional direction movement allowing member at the other end of the supporting cover 10*d* for holding each of the pair of the head-side connectors 10*b* and for allowing movement of each of the pair of head-side connectors 10*b* within a predetermined range in the three-dimensional directions. Thus, each of the pair of head-side connectors 10*b* is allowed to move in the +X direction, in the −X direction, in the +Z direction and in the −Z direction at the other end of the supporting cover 10*d* as mentioned above and to move within the predetermined range in each of the three-dimensional directions at the other end of the supporting cover 10*d*.

At the other end of the inner space in the supporting cover 10*d*, an urging means 10*j* is arranged at the ink ejecting portion 10*a* side of each of the pair of head-side connectors 10*b*, that is, the +X side. This urging means 10*j* urges each of the pair of head-side connectors 10*b* from the other end of the inner space in the supporting cover 10*d* toward outside of the −X side.

Since the pair of the engagement projections PR engage with the edges on the −X side of the pair of engagement recesses RH at the other end of the supporting cover 10*d*, each of the pair of head-side connectors 10*b* is prevented from dropping out from the other end of the inner space in the supporting cover 10*d* by the urging force of the urging means 10*j*.

In this embodiment, the urging means 10*j* is formed of a plate spring. The urging means 10*j* is fixed to the ink manifold 10*h*, so that the urging means 10*j* is arranged at a predetermined position at the other end of the inner space in the supporting cover 10*d*.

At the ends of the +Y side and the −Y side of the ink ejecting portion protecting portion 10*f* at one end of the supporting cover 10*d*, screw insertion holes SH are formed. Into the screw insertion hole SH, a fixed screw (not shown) is inserted for fixing the inkjet head 10 at the predetermined position of the inkjet head supporting structure 12 which will be described later. The diameter of the screw insertion hole SH is set larger than the diameter of the fixed screw (not shown) inserted into the screw insertion hole SH.

As a result, when the above fixed screw (not shown) is loosened after the inkjet head 10 is fixed at the predetermined position of the inkjet head supporting structure 12 by the fixed screw (not shown) inserted into the screw insertion hole SH, the inkjet head 10 can be moved in the two-dimensional manner in the +Y direction, in the −Y direction, in the +Z direction and in the −Z direction with respect to the predetermined position of the inkjet head supporting structure 12, by the above described difference in the diameters. This two-dimensional movement enables an adjustment of positions of the above-mentioned large number of inkjet nozzle NZ (See FIG. 7A) on the inkjet head 10, and this adjustment is needed for precisely recording an image on the recording media 16 on the platen 18*e* in the inkjet printer 14 using the inkjet head 10, as shown in FIG. 1.

A V-shaped groove G is formed on the end surface of the −Y side of the ink ejecting portion protecting portion 10*f*, and the groove G is used for the above two-dimensional movement.

Figure 11:
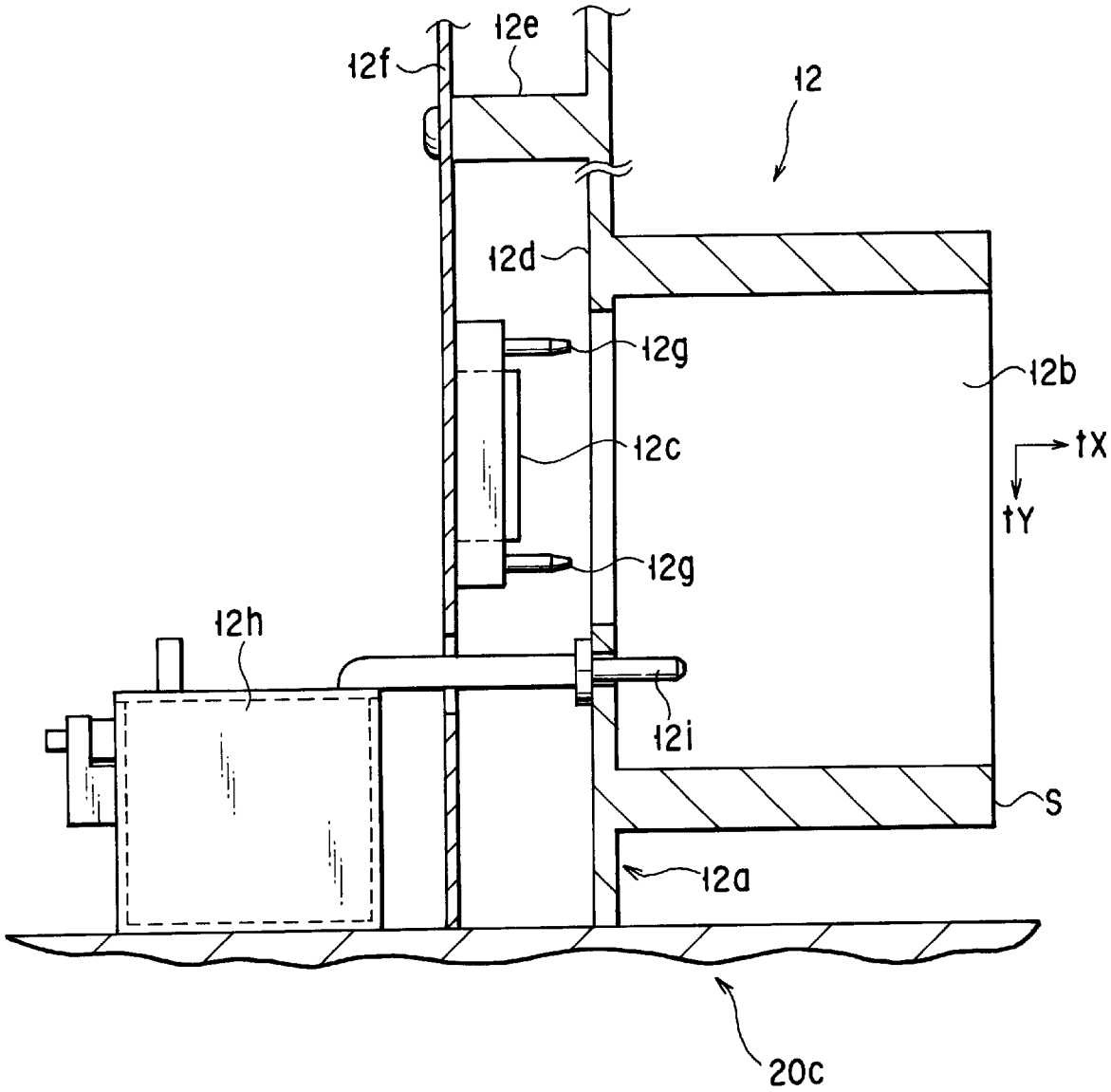
FIG. 11 is a schematic vertical sectional view of an inkjet head supporting structure to which an inkjet head according to a second embodiment of the present invention is mounted.

Next, the inkjet head supporting structure 12, to which the inkjet head 10 according to the second embodiment of the present invention and mentioned above with reference to FIGS. 7A to 10 is removably mounted, will be explained in detail, referring to FIG. 11 FIG. 11 is a schematic vertical sectional view of the inkjet head supporting structure 12.

The inkjet head supporting structure 12 is provided with an inkjet supporting base 12*a*, and the inkjet supporting base 12*a* is fixed onto the carriage body 20*c* as a head supporting member of the inkjet printer 14 shown in FIG. 1. The inkjet supporting base 12*a* is provided with an inkjet head insertion port 12*b* to which the inkjet head 10 is removably inserted. Periphery of an entrance of the inkjet head insertion port 12*b* in the inkjet supporting base 12*a* constitutes a positioning surface S extending in the Y-Z directions.

At an end opposite to the entrance of the inkjet head insertion port 12*b* in the inkjet supporting base 12*a*, a pair of connectors 12*c* for an external electric appliance are arranged. More specifically, a plurality of supporting projections 12*e* are provided on an end surface 12*d* at the end of the opposite side in the inkjet supporting base 12*a*, and the plurality of supporting projections 12*e* project in the direction opposite to the entrance of the inkjet head insertion port 12*b*.

A circuit cable 12*f* is fixed to the plurality of supporting projections 12*e*. On the circuit cable 12*f*, an electric circuit is constituted for controlling an operation of the ink ejecting portion 10*a* of the inkjet head 10 inserted into the inkjet head insertion port 12*b* and an operation of the carriage body 20*c*. The pair of connectors 12*c* are fixed side by side on the circuit cable 12*f*. The distance between the pair of connectors 12 in the +Z and −Z directions is so set that it is the same as that between the pair of head-side connectors 10*b* of the inkjet head 10 in the +Z and −Z directions.

Each of the pair of connectors 12*c* has a plurality of connection guide projections 12*g* projecting toward the entrance of the inkjet head insertion port 12*b*. The arrangement of the plurality of connection guide projections 12*g* in each of the pair of connectors 12*c* is the same as the arrangement of the connection guide holes 10*g* in each of the pair of head-side connectors 10*b*.

In the carriage body 20*c*, at a position away from the end opposite to the entrance of the inkjet head insertion port 12*b* in the inkjet head supporting base 12*a*, an ink tank 12*h* is arranged. From the ink tank 12*h*, an ink leading pipe 12*i* extends into the inkjet head insertion port 12*b* of the inkjet head supporting base 12*a* through the end opposite to the entrance of the inkjet head insertion port 12*b*.

Figure 12:
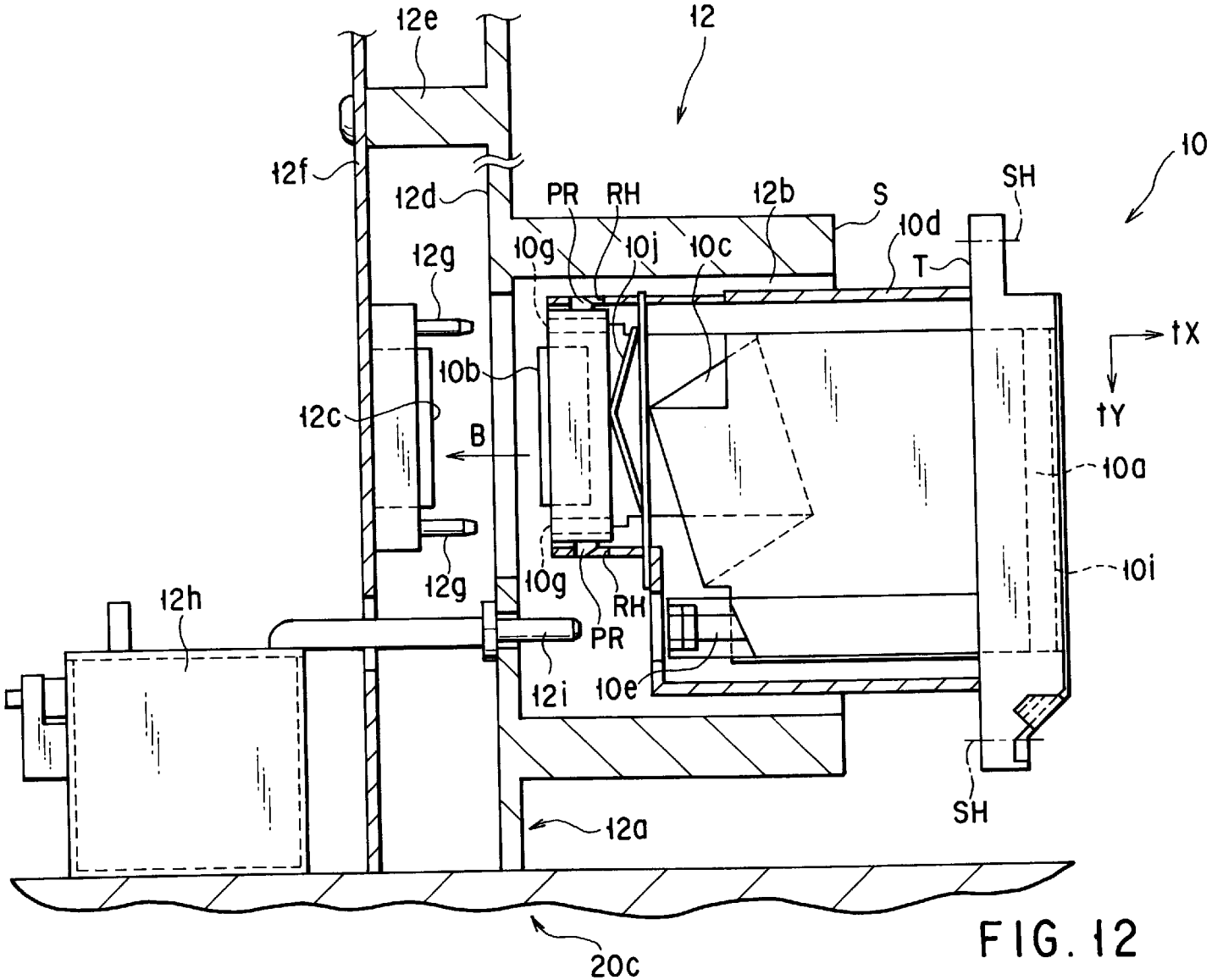
FIG. 12 is a schematic vertical sectional view showing a state where the inkjet head according to the second embodiment of the present invention is on a way to be mounted into a predetermined position of the inkjet head supporting structure shown in FIG. 11.

Next, an insertion operation of the inkjet head 10 into the inkjet head insertion port 12*b* of the inkjet head supporting structure 12 constituted as described above will be described in detail with reference to FIG. 12.

Into the inkjet head insertion port 12*b* of the inkjet head supporting structure 12, the inkjet head 10 is inserted with a pair of head-side connectors 10*b* first through the entrance on the +X side of the inkjet head insertion port 12*b*.

Figure 8:
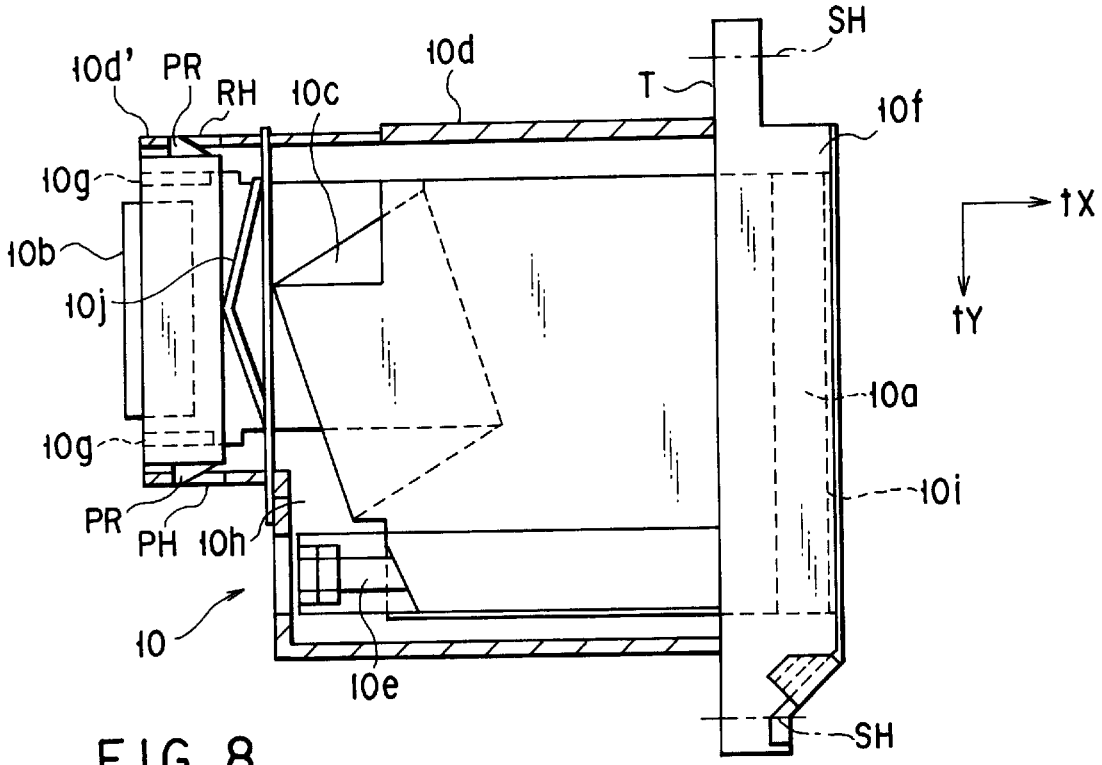
FIG. 8 is a vertical sectional view of the inkjet head shown in FIG. 7A.
Figure 9:
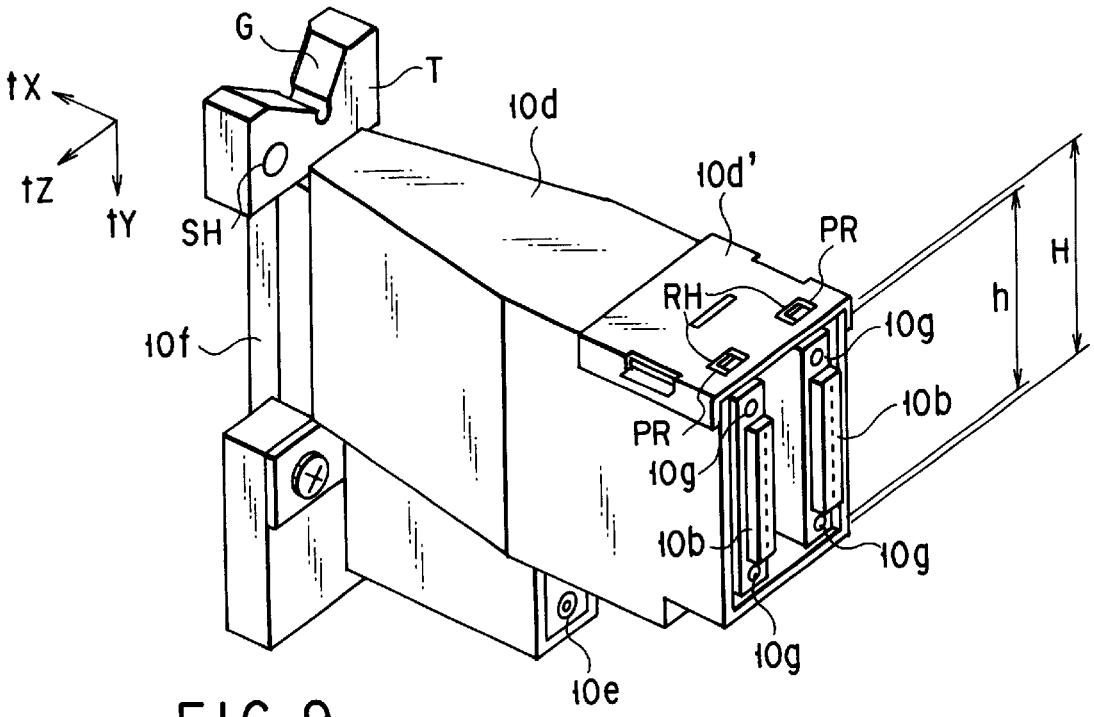
FIG. 9 is a perspective view showing the inkjet head shown in FIG. 7A when it is looked down from a position located diagonally above and rear thereto.
Figure 10:
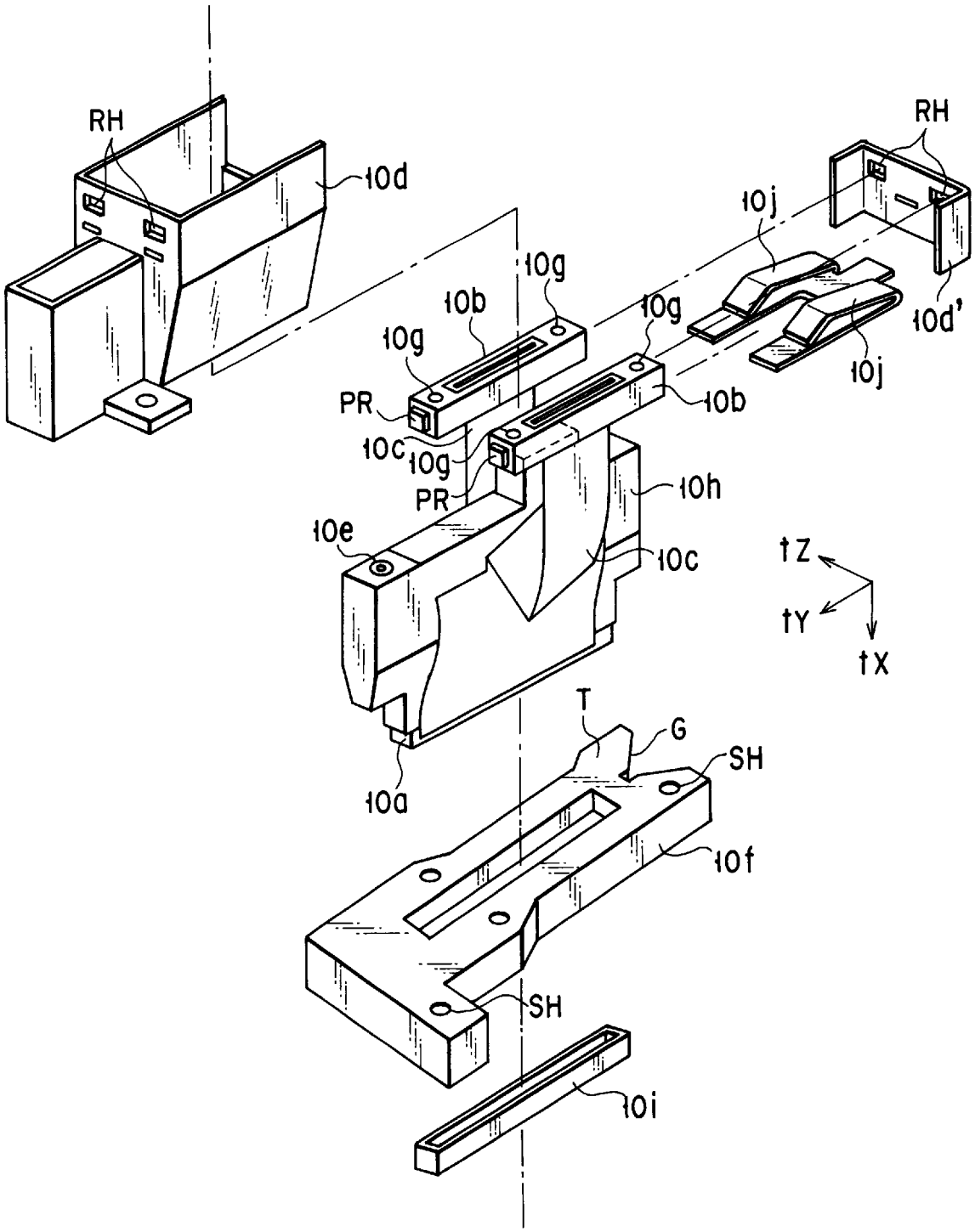
FIG. 10 is an exploded perspective view of the inkjet head shown in FIG. 7A.

The pair of the head-side connectors 10*b* of the inkjet head 10 are movable within the predetermined rage in the three-dimensional directions at the other end of the supporting cover 10*d* as mentioned above. But, as shown in FIG. 8, since the pair of engagement projections PR of each of the head-side connectors 10*b* are engaged with the edges on the −X side of the pair of corresponding engagement recesses RH of the above described other end of the supporting cover 10*d* by the urging force of the urging means 10*j*, the head-side connectors 10*b* are stably supported at the predetermined position of the above described other end. Thus, the connection guide projections 12*g* of each of the pair connectors 12*c* are easily inserted into the plurality of the connection guide holes 10*g* of each of the pair of head-side connectors 10*b*, and the pair of the head-side connectors 10*b* can be connected to the pair of connectors 12*c* of the inkjet head supporting structure 12, as shown by an arrow B in FIG. 12. Also, by the above insertion, the extended end of the ink leading pipe 12*i* from the ink tank 12*h* is inserted into the extended end of the ink supply pipe 10*e* of the inkjet head 10 and is connected with it in the water-tight manner.

Insertion of the inkjet head 10 into the inkjet head insertion port 12*b* of the inkjet head supporting base 12*a* is stopped when the contact surface T, facing the inkjet head supporting base 12, in the ink ejecting portion protecting portion 10*f* of the inkjet head 10 is brought into contact with the positioning surface S around the above described entrance of the inkjet head insertion port 12*b* in the inkjet head supporting base 12.

After that, the ink ejecting portion protecting portion 10*f* is fixed to the positioning surface S of the above described periphery of the inkjet head supporting base 12*a*. More specifically, a plurality of through holes SH are formed in the ink ejecting portion protecting portion 10*f*. And, headed bolts for fixing (not shown) are inserted into these through holes SH and screwed into the periphery of the above described entrance to accomplish the fixation.

The pair of the head-side connectors 10*b* of the inkjet head 10 are movable within the predetermined range in the +X and −X directions. Therefore, the dimensional error between the relative positions of the pair of head-side connectors 10*b* in the +X and −X directions and the relative positions of the pair of connectors 12*c* of the inkjet head supporting base 12*a* in the +X and −X directions is compensated. And, sufficient connection between the pair of the head-side connectors 10*b* and the pair of connectors 12*c* is guaranteed. Moreover, the urging force of the urging means 10*j* adjacent to the +X side of the pair of head-side connectors 10*b* guarantees to maintain the above sufficient connection.

The diameter of each of the plurality of the through holes SH is set larger than the screw portion of each of the above described headed bolts (not shown) but is set smaller than the diameter of the head portion thereof. Thus, while loosening the tightening of each of the headed bolts, the ink ejecting portion protecting portion 10*d* can be moved within the range of a clearance between the diameter of each of the through holes SH and the diameter of the screw portion of each of the headed bolts (not shown) on the positioning surface S around the above described entrance of the inkjet head supporting base 12*a*. In this state, the positions of the plurality of the inkjet nozzles NZ of the ink ejecting portion 10*a* of the inkjet head 10 can be adjusted on the inkjet head supporting base 12*a* and then, on the carriage body 20*c* shown in FIG. 1.

Since the pair of head-side connectors 10*b* are movable within the predetermined range in the +Y direction, in the −Y direction, in the +Z direction and in the −Z direction at the end of the −X side of the supporting cover 10*d* of the inkjet head 10 as mentioned above, the above described position adjustment can be performed without canceling the electric connection between the pair of head-side connectors 10*b* of the inkjet head 10 and the pair of connectors 12*c* in the inkjet head insertion port 12*b* of the inkjet head supporting base 12*a*.

Next, a structure, provided at the inkjet head supporting base 12*a*, for facilitating the above described position adjustment will be explained in detail with reference to FIG. 13.

Figure 13:
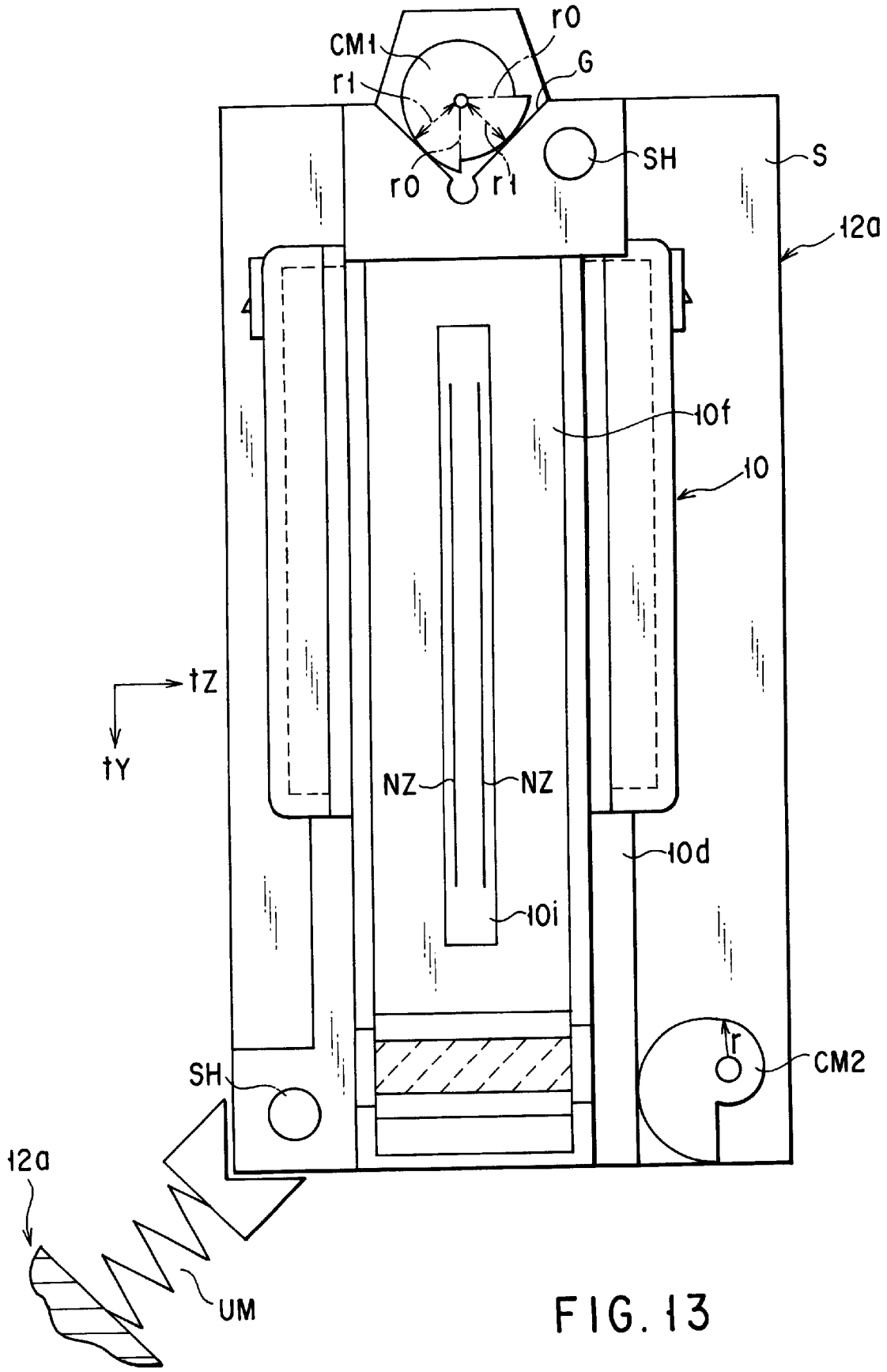
FIG. 13 is a schematic front view of the inkjet head according to the second embodiment of the present invention and the inkjet head supporting structure shown in FIG. 11 after the inkjet head is mounted to the predetermined position of the inkjet head supporting structure, wherein a constitution for adjusting a position of a group of inkjet nozzles.

FIG. 13 is a front view showing the inkjet head 10 inserted into the inkjet head insertion port 12*b* of the inkjet head supporting base 12*a*.

On the positioning surface S around the above described entrance of the inkjet head insertion port 12*b* of the inkjet head supporting base 12*a*, two eccentric cams CM1 and CM2 are rotatably provided. One eccentric cam CM1 brings its outer circumferential cam surface into contact with the V-shaped groove G on the end surface on the −Y side of the ink ejecting portion protecting portion 10*d* of the inkjet head 10 inserted into the inkjet head insertion port 12*b* of the inkjet head supporting base 12*a*, while the other eccentric cam CM2 brings its outer circumferential cam surface into contact with the side surface of the +Z side of the ink ejecting portion protecting portion 10*d* of the inkjet head 10 at the end portion of the +Y side thereof.

The outer circumferential cam surface of the one eccentric cam CM1 is constituted by two parts in which the distance r1 from the contact point between one of the both inner side surfaces of the V-shaped groove G and one of the two parts to the rotation center of the eccentric cam CM1 is identical to that from the contact point between the other of the both inner side surfaces of the V-shaped groove G and the other of the two parts to the rotational center. And, the above distance r1 is gradually increased while the one eccentric cam CM1 is rotated in one direction around the rotation center, and is gradually decreased while the one eccentric cam CM1 is rotated in the other direction around the rotation center. Thus, the ink ejecting portion protecting portion 10*d* of the inkjet head 10 (that is, the inkjet nozzles NZ) is moved only in the +Y direction when the one eccentric cam CM1 is rotated in one direction, and the ink ejecting portion protecting portion 10*d* of the inkjet head 10 (that is, the inkjet nozzles NZ) is moved only in the −Y direction when the one eccentric cam CM1 is rotated in the other direction.

The outer circumferential cam surface of the other eccentric cam CM2 is constituted such that the radius r of the cam surface is gradually increased when the other eccentric cam CM2 is rotated in one direction around its own rotation center, and is gradually decreased when the other eccentric cam CM2 is rotated in the other direction around the rotation center. Thus, the ink ejecting portion protecting portion 10*d* of the inkjet head 10 (that is, the inkjet nozzles NZ) is tilted in the −Z direction around the rotation center of the one eccentric cam CM1 when the other eccentric cam CM2 is rotated in one direction, and the ink ejecting portion protecting portion 10*d* of the inkjet head 10 (that is, the inkjet nozzles NZ) is tilted in the +Z direction around the rotation center of the one eccentric cam CM1 when the other eccentric cam CM2 is rotated in the other direction.

Moreover, at the inkjet head supporting base 12*a*, an urging means UM is provided. The urging means UM is in contact with a crossed area between the side surface on the −Z side and the end surface on the +Y side of the ejecting portion protecting portion 10*f* of the inkjet head 10 inserted in the inkjet head insertion port 12*b*, and urges the ejecting portion protecting portion 10*f* in an intermediate direction between the −Y direction and the +Z direction.

In this constitution, when the one eccentric cam CM1 is rotated, the ejecting portion protecting portion 10*f* of the inkjet head 10 (that is, the inkjet nozzles NZ) can be moved in the +Y direction or in the −Y direction within the range of the clearance between the diameter of each of the through holes SH of the ink ejecting portion protecting portion 10*d* and the diameter of the screw portion of each of the headed bolts (not shown) passing through the through holes SH, on the positioning surface S around the entrance of the inkjet head insertion port 12*b* of the inkjet head supporting base 12*a* while the protection portion 10*f* is in sliding contact with the outer circumferential cam surface of the other eccentric cam CM2. Also, when the other eccentric cam CM2 is rotated, on the positioning surface S around the above entrance of the inkjet head insertion port 12*b* of the inkjet head supporting base 12*a*, the ejecting portion protecting portion 10*f* (that is, the inkjet nozzles NZ) can be swung in the +Z direction or in the −Z direction around the rotational center of one eccentric cam CM1 within the range of the clearance between the diameter of each of the through holes SH of the ink ejecting portion protecting portion 10*d* and the diameter of the screw portion of each of the headed bolts (not shown) passing through the through holes SH, on the positioning surface S around the entrance of the inkjet head insertion port 12*b* of the inkjet head supporting base 12*a* while the two inner side surfaces of the V-shaped groove G on the end surface of the ejecting portion protecting portion 10*f* of the inkjet head 10 are in contact with the two parts of the outer circumferential cam surface of the one eccentric cam CM1.

Next, referring to FIGS. 14A, 14B, 14C and 14D, various variations of the inkjet head 10 will be explained, and all these figures are horizontal bottom sectional views showing the enlarged horizontal cross sections of the bottoms of the various variations. And, most of the constitutional members of each of these various variations are identical to most of the constitutional members of the inkjet head 10 according to the above-mentioned second embodiment referring to FIG. 7A through FIG. 10. Thus, those of the constitutional members of each of these various variations, which are the same as the those of constitutional members of the inkjet head 10, are denoted by the same reference numerals as those denoting the corresponding constitutional members in the inkjet head 10, and detailed explanations thereof will be omitted.

Figure 14A:
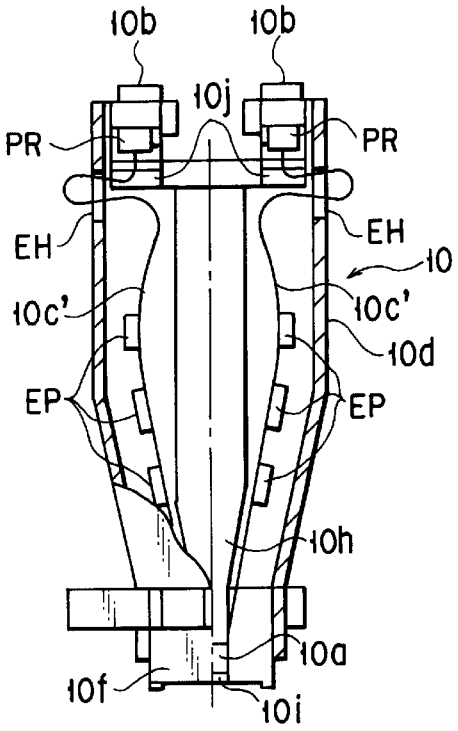
FIGS. 14A, 14B, 14C and 14D are schematic horizontal bottom section views showing first through fourth variations of the inkjet head according to the second embodiment of the present invention.

In the first variation in FIG. 14A, electric connecting portion insertion holes EH are formed in the end portions on the −X side at both side surfaces in the +Z direction and in the −Z direction of the supporting case 10*d*. And, into each of the pair of these electric connecting portion insertion holes EH, a part of each of a pair of electric connecting portions 10*c*′ consisting of a pair of flexible printed circuit cables in the supporting case 10*d* is inserted and extended outward. The pair of electric connecting portions 10*c*′ arranged in the supporting case 10*d* as described above generate two relatively large clearances between the both side surfaces of the ink manifold 10*h* in the +Z direction and in the −Z direction and the both inner side surfaces of the supporting case 10*d*, in the +Z direction and in the −Z direction, and enables mounting of an electric or electronic part of the relatively large dimension in each of these relatively large clearances. Moreover, a part of each of the pair of electric connecting portions 10*c*′ extending outward through each of the electric connecting portion insertion holes EH of the supporting case 10*d* acts as an urging means for each of the pair of head-side connectors 10*b*, and enables size reduction of each of the pair of urging means 10*j* arranged adjacent to the +X side of each of the pair of head-side connectors 10*b*. As a result of this, the dimensions of the supporting case 10*d* and then, those of the inkjet head 10 in the +X direction and in the −X direction can be made small.

Figure 14B:
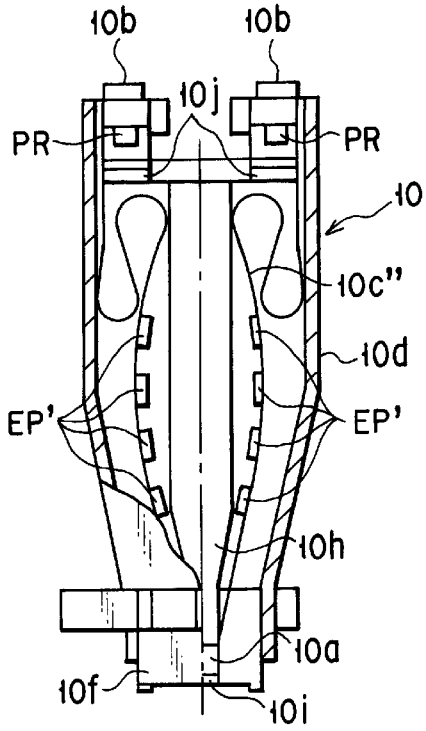

In the second variation in FIG. 14B, the difference from the constitution of the inkjet head 10 according to the above-mentioned embodiment is that various electric or electronic parts EP' are mounted on the inner side surfaces of a pair of electric connection portions 10", facing the both side surfaces of the ink manifold 10*h* in the +Z direction and in the −Z direction in the supporting case 10*d*.

Figure 14C:
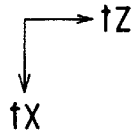
Figure 14C:
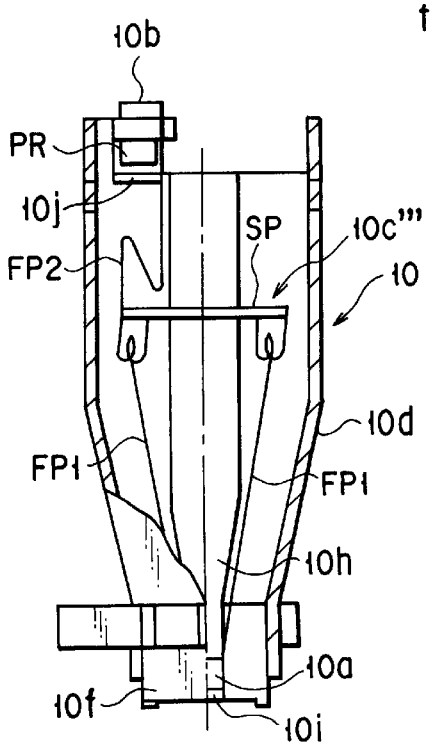

In the third variation in FIG. 14C, only one head-side connector 10*b* is provided at the other end on the −X side of the supporting case 10*d*, so that the head-side connector 10*b* is movable within a predetermined range in the three-dimensional directions as mentioned above. Further, an electric connecting portion 10*c*''' in the supporting case 10*d* is constituted by three members. That is, the electric connection potion 10*c*'''is constituted by a pair of first flexible printed circuit cables FP1, extending along the both side surfaces of the ink manifold 10*h* in the +Z direction and in the −Z direction from the ink ejecting portion 10*a* toward the other end of the supporting case 10*d* on the −X side, a solid board SP arranged between both ends of the supporting case 10*d*, one end of which is on the +X side where the ink ejecting portion 10*a* is arranged and the other end of which is on the −X side, and a single second flexible printed circuit cable FP2, extending with bending at two positions toward the single head-side connector 10*b* from the solid board SP, for electrically connecting its extended end to the head-side connector 10*b*.

In this third variation, the solid board SP may or may not be fixed in the supporting case 10*d*. If fixed, only the single second flexible printed circuit cable FP2 allows a movement of the single head-side connector 10*b* within the predetermined range in each of the three-dimensional directions. If not fixed, in addition to the single second flexible printed circuit cable FP2, the pair of first flexible printed circuit cables FP1 also allow the movement of the single head-side connector 10*b* within the predetermined range in the each of three-dimensional directions.

Figure 14D:
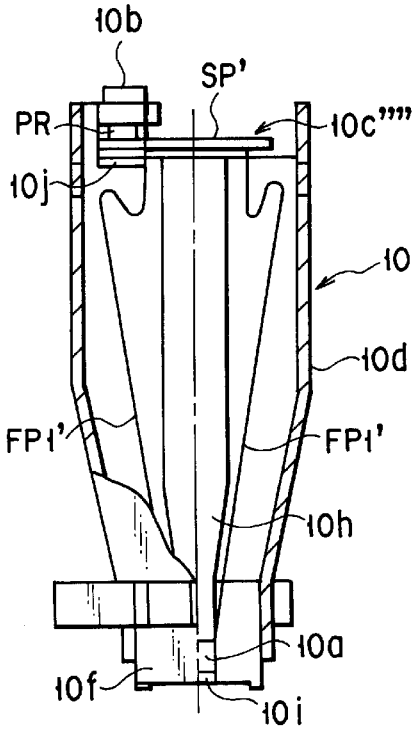
Figure 15:
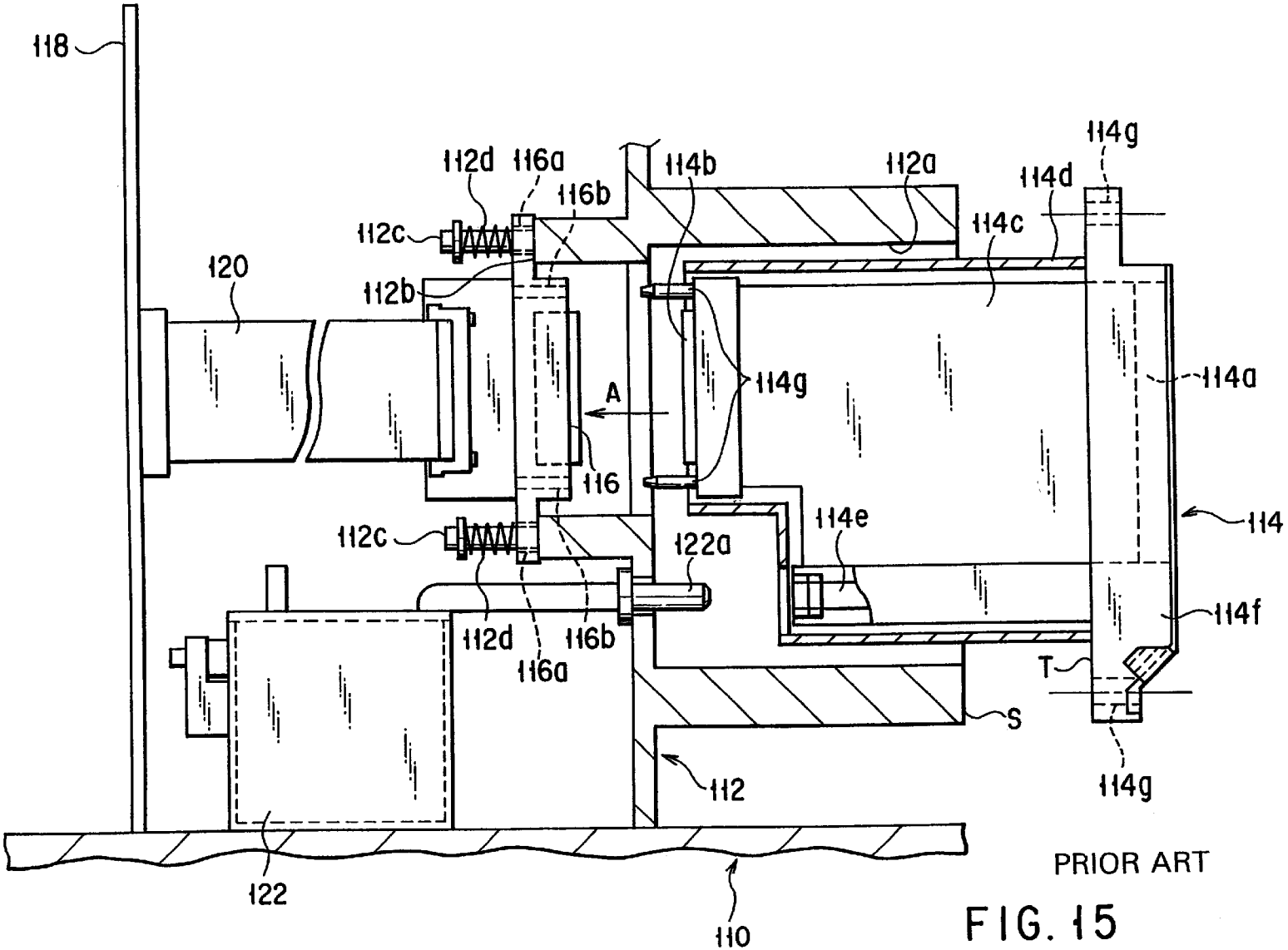
PRIOR ART FIG. 15
FIG. 15 is a schematic vertical sectional view showing a state where a conventional inkjet head is on a way to be mounted into a conventional inkjet head supporting structure.

In the fourth variation in FIG. 14D, only one head-side connector 10*b* is provided at the other end of the supporting case 10*d* on the −X side so that the head-side connector 10*b* is movable within a predetermined range in the three-dimensional directions as mentioned above. And, an electric connecting portion 10*c*'''' in the supporting case 10*d* is constituted by two members. That is, the electric connection potion 10*c*'''' is constituted by a pair of first flexible printed circuit cables FP1', extending along the both side surfaces of the ink manifold 10*h* in the +Z direction and in the −Z direction from the ink ejecting portion 10*a* toward the other end of the supporting case 10*d* on the −X side, and a solid board SP', arranged on the other end of the supporting case 10*d* on the −X side. The extended end of each of the pair of first flexible printed circuit cable FP1 is electrically connected to the solid board SP', and the single head-side connector 10*b* is fixed thereto.

In this fourth variation, the solid board SP' is not fixed to the supporting case 10*d* to allow the movement of the head-side connector 10*b* in each of the three-dimensional directions.

According to the principle of the present invention, the supporting structure for allowing the three-dimensional movements of the head-side connector 10*b* in the inkjet head 10 can be used as a supporting structure for allowing the three-dimensional movements of the connector 12*c* in the inkjet head supporting structure 12 in the carriage body 20*c* of the carriage means 20 (See FIG. 1). In this case, even if the head-side connector 10*b* is fixed to the supporting structure of the inkjet head 10, the position adjustment of the ink nozzles NZ in the inkjet head 10 can be performed without interrupting the electrical connection between the head-side connector 10*b* and the connector 12*c* of the inkjet head supporting structure 12.

In more detail, a pair of engagement projections are projected in the +Y direction and in the −Y direction from the +Y side end surface and from the −Y side end surface of the connector 12*c*. A connector supporting member, in which a connector storing opening is formed for storing the connector 12*c*, is provided on the circuit cable 12*f*. The outer dimension of the connector storing opening is set larger than the outer dimension of the connector 12*c* so that the movement of the connector 12*c* in each of the three-dimensional directions is allowed in the connector storing opening. A pair of engagement holes are formed in the +Y side end surface and in the −Y side end surface of the connector supporting member respectively for receiving the two pairs of engagement projections of the connector 12*c*. The dimension in each of the +X direction, the −X direction, the +Z direction and the −Z direction of each engagement hole is set larger than the dimension in each of the +X direction, the −X direction, the +Z direction and the −Z direction of each engagement projection. The distance between the pair of engagement holes in the +Y direction and in the −Y direction is set larger than the distance between the +Y side end surface and the −Y side end surface of the connector 12*c* but smaller than the total of the distance between the +Y side end surface and the −Y side end surface of the connector 12*c*, and the projecting height of each engagement projection in the +Y direction and in the −Y direction.

And, in order to facilitate the connection work of the head-side connector 10*b* of the inkjet head 10 to the connector 12*c*, the connector 12*c* can be urged in the +X direction so that each engagement projection of the connector 12*c* is pressed on each engagement hole of the connector supporting member in the +X direction and the position of the connector 12*c* in the connector storing opening of the connector supporting member is stabilized.

In the above-mentioned second embodiment, the pair of electric connecting portions 10*c* are interposed between the ink ejecting portion 10*a* at the one end of the inkjet head 10 and the pair of head-side connectors 10*b* at the other end, but the number of the electric connecting portion 10*c* may be more than one pair or one, and the number of the head-side connector 10*b* may be more than one pair or one. That is, the ink ejecting portion 10*a* can be electrically connected to a pair or more of the plural head-side connectors 10*b* with a single electric connecting portion 10*c*, and the ink ejecting portion 10*a* and a single head-side connector 10*b* can be electrically connected to a single or a pair or more of the plural electric connecting portions 10*c*. of course, the ink ejecting portion 10*a* and a pair or more of the plural head-side connectors 10*b* can be electrically connected by a pair or more of the plural electric connecting portions 10*c*.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An inkjet head comprising:

a head body for ejecting ink;

a flexible printed circuit cable, connected to the head body, for driving the head body;

a connector, connected to a position different from the head body on the flexible printed circuit cable, for receiving a signal for driving the head body from an external electric appliance, and for sending the signal to the flexible printed circuit cable; and a case in which the head body, the flexible printed circuit cable and the connector are contained, wherein the flexible printed circuit cable is bent between the head body and the connector in the case, and the connector is movable with respect to the case.

2. An inkjet head according to claim 1, wherein the flexible printed circuit cable is bent so that the connector and the head body are oriented in opposite directions.

3. An inkjet head according to claim 2, wherein the inkjet head further comprises an urging member, and the urging member urges the connector toward the external electric appliance.

4. An inkjet head according to claim 1, wherein the flexible printed circuit cable is bent so that the connector and the head body are arranged such that a straight line along a direction in which the connector is oriented crosses a straight line along a direction in which the head body is oriented.

5. An inkjet head according to claim 4, wherein the inkjet head further comprises an urging member, and the urging member urges the connector toward the external electric appliance.

6. An inkjet head according to claim 1, wherein the flexible printed circuit cable extends between the head body and the connector, and the flexible printed circuit cable is bent in a longitudinal direction of the flexible printed circuit cable so that the connector and the head body are oriented in opposite directions.

7. An inkjet head according to claim 6, wherein the inkjet head further comprises an urging member, and the urging member urges the connector toward the external electric appliance.

8. An inkjet head according to claim 1, wherein the flexible printed circuit cable extends between the head body and the connector, and the flexible printed circuit cable is bent in a direction crossing a longitudinal direction of the flexible printed circuit cable so that the connector and the head body are arranged such that a straight line along a direction in which the connector is oriented crosses a-straight line along a direction in which the head body is oriented.

9. An inkjet head according to 8, wherein the inkjet head further comprises an urging member, and the urging member urges the connector toward the external electric appliance.

10. An inkjet head according to claim 1, wherein the connector is contained in the case such that the connector is movable in directions in which the connector is connected to or disconnected from the external electric appliance.

11. An inkjet head according to claim 1, wherein the inkjet head further comprises an urging member, and the urging member urges the connector toward the external electric. appliance.

12. An inkjet head according to claim 1, wherein the connector is contained in the case such that the connector is movable in directions perpendicular to directions in which the connector is connected to or disconnected from the external electric appliance.

13. An inkjet head comprising:

an ink ejecting portion to which ink is supplied and which ejects the supplied ink;

a head-side connector for electric connection with a connector of an external electric appliance in a removable manner;

an electric connection portion, interposed between the ink ejecting portion and the head-side connector, for electric connection between the ink ejecting portion and the head-side connector; and a head case for supporting the ink ejecting portion, the head-side connector and the electric connection portion, wherein the head-side connector is supported by the head case so that the head-side connector is movable in three-dimensional directions.

14. An inkjet head according to claim 13, further comprising an urging means, provided at the head case, for urging the head-side connector toward the connector of the external electric appliance.

15. An inkjet head according to claim 14, wherein at least a part of the electric connection portion has elasticity and functions as the urging means.

16. An inkjet head according to claim 13, wherein the electric connection portion is arranged between the ink ejecting portion and the head-side connector so that the electric connection portion is capable of relative movement at least against the head-side connector and the electric connection portion allows movement of the head-side connector in the three-dimensional directions.

17. An inkjet head according to claim 13, wherein at least a part of the electric connection portion has flexibility.

18. An inkjet head, incorporated at a predetermined position of a supporting member of an inkjet printer and connected to an electric-current-supply-side connector, comprising:

an ink ejecting portion for ejecting ink;

a head-side connector for removably connecting to the electric-current-supply-side connector;

a flexible printed circuit cable, interposed between the ink ejecting portion and the head-side connector, for electric connection between the ink ejecting portion and the head-side connector; and a case for housing the ink ejecting portion, the head-side connector and the flexible printed circuit cable, wherein the ink ejecting portion is fixed to the case and the head-side connector is held by the case so that the head-side connector is movable in three-dimensional directions.

19. An inkjet head according to claim 18, wherein the flexible printed circuit cable is movable between the ink ejecting portion and the head-side connector within the case.

20. An inkjet head according to claim 19, wherein a length of the flexible printed circuit cable between the head-side connector and the ink ejecting portion is set longer than a shortest distance between the head-side connector and the ink ejecting portion.

21. An inkjet head according to claim 19, wherein the flexible printed circuit cable is bent between the ink ejecting portion and the head-side connector within the case.

22. An inkjet head according to claim 21, wherein the flexible printed circuit cable is bent at least twice.

23. An inkjet head according to claim 21, wherein the flexible printed circuit cable is bent so that the head-side connector and the ink ejecting portion are oriented in opposite directions.

24. An inkjet head according to claim 21, wherein the flexible printed circuit cable is bent so that the head-side connector and the ink-ejecting portion are arranged such that a straight line along a direction in which the head-side connector is oriented crosses a straight line along a direction in which the ink ejecting portion is oriented.

25. An inkjet head according to claim 19, further comprising an urging means for urging the head-side connector outward.

26. An inkjet head according to claim 19, wherein an ink ejection driving integrated circuit for driving an ink ejection operation of the ink ejecting portion is mounted on the flexible printed circuit cable.

* * * * *